US008424168B2

(12) United States Patent
Soderberg et al.

(10) Patent No.: US 8,424,168 B2
(45) Date of Patent: Apr. 23, 2013

(54) CLOSURE SYSTEM

(75) Inventors: Mark S. Soderberg, Evergreen, CO (US); Eric Craig Irwin, Lakewood, CO (US)

(73) Assignee: Boa Technology, Inc., Denver, CO (US)

( * ) Notice: Subject to any disclaimer, the term of this patent is extended or adjusted under 35 U.S.C. 154(b) by 629 days.

(21) Appl. No.: 12/355,675

(22) Filed: Jan. 16, 2009

(65) Prior Publication Data

US 2009/0184189 A1 Jul. 23, 2009

Related U.S. Application Data

(60) Provisional application No. 61/022,045, filed on Jan. 18, 2008.

(51) Int. Cl.

| | |
|---|---|
| ***A43C 11/00*** | (2006.01) |
| ***A44B 11/00*** | (2006.01) |
| ***A44B 11/25*** | (2006.01) |

(52) U.S. Cl.

USPC ..... 24/68 B; 24/68 SK; 24/71.1; 36/50.1; 36/50.5; 2/417; 2/418; 2/159

(58) Field of Classification Search ..... 24/68 B, 24/68 SK, 71.1, 590.1, 591.1, 629, 633, 636, 24/643, 645, 646, DIG. 43, DIG. 46–DIG. 48, 24/DIG. 51, DIG. 55, DIG. 56; 2/8.1, 417, 2/418, 425, 267, 159; 36/50.1, 50.5

See application file for complete search history.

(56) References Cited

U.S. PATENT DOCUMENTS

| | | | | |
|---|---|---|---|---|
| 59,332 A * | 10/1866 | White et al. | ..... | 24/68 B |
| 80,834 A | 8/1868 | Prussia | | |
| 117,530 A | 8/1871 | Foote | | |
| 228,946 A | 6/1880 | Schulz | | |
| 230,759 A | 8/1880 | Drummond | | |
| 568,056 A | 9/1896 | Vail, Jr. | | |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

Re-Examination of U.S. Patent No. 7,591,050, Re-Exam Control No. 90/011,028, including its ongoing prosecution history, filed Jun. 11, 2010, Gary R. Hammerslag.

(Continued)

*Primary Examiner* — Robert J Sandy
*Assistant Examiner* — Abigail E Morrell
(74) *Attorney, Agent, or Firm* — Knobbe Martens Olson & Bear LLP

(57) ABSTRACT

By way of example, a cam assembly and strap based closure system using a spiral is configured for bringing two sides of an article together. When the user inserts the strap into the cam assembly and turns a knob, the strap is driven into the cam assembly and the strap pins engage one or more cam spirals. The system is configured such that strap pins are engaged at a constant angle which may be self-locking. The system is infinitely adjustable and the torque felt by the knob is constant. The system is configured to be a quick release system and allows rapid insertion of the strap for faster operation.

40 Claims, 30 Drawing Sheets

U.S. PATENT DOCUMENTS

| | | | |
|---|---|---|---|
| 746,563 | A | 12/1903 | McMahon |
| 908,704 | A | 1/1909 | Sprinkle |
| 1,060,422 | A | 4/1913 | Bowdish |
| 1,062,511 | A | 5/1913 | Short |
| 1,090,438 | A | 3/1914 | Worth et al. |
| 1,170,472 | A | 2/1916 | Barber |
| 1,288,859 | A | 12/1918 | Feller et al. |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |
| 1,481,903 | A | 4/1923 | Hart |
| 1,530,713 | A | 2/1924 | Clark |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,539,026 | A | 1/1951 | Mangold |
| 2,611,940 | A | 9/1952 | Cairns |
| 2,673,381 | A | 3/1954 | Dueker |
| 2,802,212 | A | 8/1957 | Finken |
| 2,869,137 | A | 1/1959 | Sherz |
| 2,907,086 | A | 10/1959 | Ord |
| 2,991,523 | A | 7/1961 | Del Conte |
| 3,035,319 | A | 5/1962 | Wolff |
| 3,112,545 | A | 12/1963 | Williams |
| 3,163,900 | A | 1/1965 | Martin |
| 3,169,325 | A | 2/1965 | Fesl |
| 3,197,155 | A | 7/1965 | Chow |
| 3,221,384 | A | 12/1965 | Aufenacker |
| 3,276,090 | A | 10/1966 | Nigon |
| 3,329,968 | A | 7/1967 | Gordon |
| 3,357,026 | A | 12/1967 | Wiegandt |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 3,860,997 | A | 1/1975 | Van Riper, Jr. et al. |
| 3,934,346 | A | 1/1976 | Sasaki et al. |
| 3,992,720 | A | 11/1976 | Nicolinas |
| 4,051,555 | A | 10/1977 | Daly |
| 4,095,354 | A | 6/1978 | Annovi |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,279,037 | A | 7/1981 | Morgan |
| 4,292,692 | A | 10/1981 | Moretti et al. |
| 4,408,403 | A | 10/1983 | Martin |
| 4,433,456 | A | 2/1984 | Baggio |
| 4,433,679 | A | 2/1984 | Mauldin et al. |
| 4,463,761 | A | 8/1984 | Pols et al. |
| 4,480,395 | A | 11/1984 | Schoch |
| 4,551,932 | A | 11/1985 | Schoch |
| 4,555,830 | A | 12/1985 | Petrini et al. |
| 4,574,500 | A | 3/1986 | Aldinio et al. |
| 4,616,524 | A | 10/1986 | Biodia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,727,630 | A | 3/1988 | Alan |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,793,001 | A | 12/1988 | Accardi |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,827,796 | A | 5/1989 | Horian |
| 4,841,649 | A | 6/1989 | Baggio et al. |
| 4,856,207 | A | 8/1989 | Datson |
| 4,870,723 | A | 10/1989 | Pozzobon et al. |
| 4,870,761 | A | 10/1989 | Tracy |
| 4,884,760 | A | 12/1989 | Baggio et al. |
| 4,937,953 | A | 7/1990 | Walkhoff |
| 4,942,628 | A | 7/1990 | Freund |
| 4,961,544 | A | 10/1990 | Biodia |
| 4,999,846 | A | 3/1991 | Ball et al. |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | De Bortoli |
| 5,065,481 | A | 11/1991 | Walkhoff |
| 5,117,567 | A | 6/1992 | Berger |
| 5,129,130 | A | 7/1992 | Lecouturier |
| 5,152,038 | A | 10/1992 | Schoch |
| 5,157,813 | A | 10/1992 | Carroll |
| 5,158,428 | A | 10/1992 | Gessner et al. |
| 5,167,612 | A | 12/1992 | Bonutti |
| 5,177,882 | A | 1/1993 | Berger |
| 5,178,137 | A | 1/1993 | Goor et al. |
| 5,181,331 | A | 1/1993 | Berger |
| 5,184,378 | A | 2/1993 | Batra |
| D333,552 | S | 3/1993 | Berger et al. |
| 5,213,094 | A | 5/1993 | Bonutti |
| 5,249,377 | A | 10/1993 | Walkhoff |
| 5,259,094 | A | 11/1993 | Zepeda |
| 5,267,967 | A | 12/1993 | Schneider |
| 5,315,741 | A | 5/1994 | Debberke |
| 5,319,868 | A | 6/1994 | Hallenbeck |
| 5,325,613 | A | 7/1994 | Sussmann |
| 5,327,662 | A | 7/1994 | Hallenbeck |
| 5,331,687 | A | 7/1994 | Kronenberger |
| 5,335,401 | A | 8/1994 | Hanson |
| 5,341,583 | A | 8/1994 | Hallenbeck |
| 5,345,697 | A | 9/1994 | Quellais |
| 5,346,461 | A | 9/1994 | Heinz et al. |
| 5,355,596 | A | 10/1994 | Sussmann |
| 5,357,654 | A | 10/1994 | Hsing-Chi |
| 5,365,947 | A | 11/1994 | Bonutti |
| 5,381,609 | A | 1/1995 | Hieblinger |
| 5,384,916 | A | 1/1995 | Portney |
| 5,395,304 | A | 3/1995 | Tarr et al. |
| 5,425,161 | A | 6/1995 | Schoch |
| 5,425,185 | A | 6/1995 | Gansler |
| 5,430,960 | A | 7/1995 | Richardson |
| 5,433,648 | A | 7/1995 | Frydman |
| 5,437,617 | A | 8/1995 | Heinz et al. |
| 5,456,268 | A | 10/1995 | Bonutti |
| 5,463,822 | A | 11/1995 | Miller |
| 5,477,593 | A | 12/1995 | Leick |
| 5,502,902 | A | 4/1996 | Sussmann |
| 5,511,251 | A | 4/1996 | Brakas |
| 5,511,325 | A | 4/1996 | Hieblinger |
| 5,535,531 | A | 7/1996 | Karabed et al. |
| 5,537,763 | A | 7/1996 | Donnadieu et al. |
| 5,557,864 | A | 9/1996 | Marks |
| 5,566,474 | A | 10/1996 | Leick et al. |
| 5,596,820 | A | 1/1997 | Edauw et al. |
| 5,599,000 | A | 2/1997 | Bennett |
| 5,599,288 | A | 2/1997 | Shirley et al. |

5,600,874 A 2/1997 Jungkind
5,606,778 A 3/1997 Jungkind
5,619,747 A 4/1997 Boisclair et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,685,830 A 11/1997 Bonutti
5,718,021 A 2/1998 Tatum
5,718,065 A 2/1998 Locker
5,732,483 A 3/1998 Cagliari
5,736,696 A 4/1998 Del Rosso
5,737,854 A 4/1998 Sussmann
5,755,044 A 5/1998 Veylupek
5,761,777 A 6/1998 Leick
5,784,809 A 7/1998 McDonald
5,819,378 A 10/1998 Doyle
5,833,640 A 11/1998 Vazquez, Jr. et al.
5,891,061 A 4/1999 Kaiser
5,934,599 A 8/1999 Hammerslag
5,950,245 A 9/1999 Binduga
5,956,823 A 9/1999 Borel
6,038,791 A 3/2000 Cornelius et al.
6,052,921 A 4/2000 Oreck
6,070,886 A 6/2000 Cornelius et al.
6,070,887 A 6/2000 Cornelius et al.
6,102,412 A 8/2000 Staffaroni
6,119,318 A 9/2000 Maurer
6,128,836 A 10/2000 Barret
6,148,489 A 11/2000 Dickie et al.
6,202,953 B1 3/2001 Hammerslag
6,219,889 B1 4/2001 Lovato et al.
6,256,798 B1 7/2001 Egolf et al.
6,267,390 B1 7/2001 Maravetz et al.
6,289,558 B1 9/2001 Hammerslag
6,314,587 B1 11/2001 Fang
6,416,074 B1 7/2002 Maravetz et al.
6,457,210 B1 10/2002 Shirai et al.
6,464,657 B1 10/2002 Castillo
6,467,195 B2 10/2002 Pierre et al.
6,477,793 B1 11/2002 Pruitt et al.
6,543,159 B1 4/2003 Carpenter et al.
6,568,103 B2 5/2003 Durocher
6,685,662 B1 2/2004 Curry et al.
6,689,080 B2 2/2004 Castillo
6,708,376 B1 3/2004 Landry
6,711,787 B2 3/2004 Jungkind et al.
6,718,557 B2 4/2004 Claro
6,757,991 B2 7/2004 Sussmann
6,775,928 B2 8/2004 Grande et al.
6,793,641 B2 9/2004 Freeman et al.
6,796,951 B2 9/2004 Freeman et al.
6,802,439 B2 10/2004 Azam et al.
6,877,256 B2 4/2005 Martin et al.
6,918,139 B2 7/2005 Okot
6,922,917 B2 8/2005 Kerns et al.
6,938,913 B2 9/2005 Elkington
6,941,581 B1 9/2005 England et al.
6,942,632 B2 9/2005 Cho
6,945,543 B2 9/2005 De Bortoli et al.
6,962,571 B2 11/2005 Castillo
6,976,972 B2 12/2005 Bradshaw
6,993,859 B2 2/2006 Martin et al.
7,024,702 B2 4/2006 Kronenberger
7,043,772 B2 5/2006 Bielefeld et al.
7,076,843 B2 7/2006 Sakabayashi
7,082,701 B2 8/2006 Dalgaard et al.
7,134,224 B2 11/2006 Elkington et al.
7,159,247 B2 1/2007 Kim
7,182,740 B1 2/2007 Castillo
7,198,610 B2 4/2007 Ingimundarson et al.
7,246,383 B2 7/2007 Musal
7,278,173 B2 10/2007 Turner
7,281,341 B2 10/2007 Reagan et al.
7,290,293 B2 11/2007 Kanitz
7,293,373 B2 11/2007 Reagan et al.
7,314,458 B2 1/2008 Bodenschatz
7,331,126 B2 2/2008 Johnson
7,386,947 B2 6/2008 Martin et al.
7,402,147 B1 7/2008 Allen
7,490,458 B2 2/2009 Ford
7,516,914 B2 4/2009 Kovacevich et al.
7,584,528 B2 9/2009 Hu
7,591,026 B2 9/2009 Kronenberger
7,591,050 B2 9/2009 Hammerslag
7,597,675 B2 10/2009 Ingimundarson et al.
7,600,660 B2 10/2009 Kasper et al.
7,614,090 B2 11/2009 Kronenberger
7,617,573 B2 11/2009 Chen
7,618,386 B2 11/2009 Nordt, III et al.
7,618,389 B2 11/2009 Nordt, III et al.
7,648,404 B1 1/2010 Martin
7,662,122 B2 2/2010 Sterling
7,665,154 B2 2/2010 Gerstel Costello
7,694,354 B2 4/2010 Philpott et al.
7,704,219 B2 4/2010 Nordt, III et al.
7,713,225 B2 5/2010 Ingimundarson et al.
7,789,844 B1 9/2010 Allen
7,794,418 B2 9/2010 Ingimundarson et al.
7,806,842 B2 10/2010 Stevenson et al.
7,819,830 B2 10/2010 Sindel et al.
7,871,334 B2 1/2011 Young et al.
7,877,845 B2 2/2011 Signori
7,878,998 B2 2/2011 Nordt, III et al.
7,887,500 B2 2/2011 Nordt, III et al.
7,896,827 B2 3/2011 Ingimundarson et al.
7,908,769 B2 3/2011 Pellegrini
7,922,680 B2 4/2011 Nordt, III et al.
7,935,068 B2 5/2011 Einarsson
7,947,005 B2 5/2011 Castillo
7,950,112 B2 5/2011 Hammerslag et al.
7,954,204 B2 6/2011 Hammerslag et al.
7,992,261 B2 8/2011 Hammerslag et al.
7,993,296 B2 8/2011 Nordt, III et al.
8,016,781 B2 9/2011 Ingimundarson et al.
8,056,150 B2 11/2011 Stokes et al.
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
8,231,074 B2 7/2012 Hu et al.
2002/0052568 A1 5/2002 Houser et al.
2002/0095750 A1 7/2002 Hammerslag
2002/0108165 A1 8/2002 Porter et al.
2002/0178548 A1 12/2002 Freed
2003/0131396 A1 7/2003 Park
2003/0177662 A1 9/2003 Elkington et al.
2003/0204938 A1 11/2003 Hammerslag
2005/0054962 A1 3/2005 Bradshaw
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0198866 A1 9/2005 Wiper et al.
2005/0273025 A1 12/2005 Houser
2006/0156517 A1 7/2006 Hammerslag et al.
2006/0185193 A1 8/2006 Pellegrini
2007/0113524 A1 5/2007 Lander
2007/0128959 A1 6/2007 Cooke
2007/0169378 A1 7/2007 Sodeberg et al.
2007/0226875 A1 10/2007 Lee
2007/0245456 A1 10/2007 Cho
2007/0276306 A1 11/2007 Castillo
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0083135 A1 4/2008 Hammerslag et al.
2009/0099562 A1 4/2009 Ingimudarson et al.
2009/0124948 A1 5/2009 Ingimundarson et al.
2009/0172928 A1 7/2009 Messmer et al.
2009/0287128 A1 11/2009 Ingimundarson et al.
2010/0081979 A1 4/2010 Ingimundarson et al.
2010/0094189 A1 4/2010 Ingimundarson et al.

| | | | |
|---|---|---|---|
| 2010/0101061 | A1 | 4/2010 | Ha |
| 2010/0139057 | A1 | 6/2010 | Soderberg et al. |
| 2010/0154254 | A1 | 6/2010 | Fletcher |
| 2010/0174221 | A1 | 7/2010 | Ingimundarson et al. |
| 2010/0175163 | A1 | 7/2010 | Litke |
| 2010/0217169 | A1 | 8/2010 | Ingimundarson |
| 2010/0251524 | A1 | 10/2010 | Chen |
| 2010/0331750 | A1 | 12/2010 | Ingimundarson |
| 2011/0000173 | A1 | 1/2011 | Lander |
| 2011/0004135 | A1 | 1/2011 | Kausek |
| 2011/0098618 | A1 | 4/2011 | Fleming |
| 2011/0099690 | A1 | 5/2011 | Higgins et al. |
| 2011/0144554 | A1 | 6/2011 | Weaver Ll et al. |
| 2011/0167543 | A1 | 7/2011 | Kovacevich et al. |
| 2011/0178448 | A1 | 7/2011 | Einarsson |
| 2011/0184326 | A1 | 7/2011 | Ingimundarson et al. |
| 2011/0191992 | A1 | 8/2011 | Chen |
| 2011/0218471 | A1 | 9/2011 | Ingimundarson et al. |
| 2011/0283440 | A1 | 11/2011 | Higgins et al. |
| 2011/0288461 | A1 | 11/2011 | Arnold et al. |
| 2011/0301521 | A1 | 12/2011 | Weissenb ck et al. |
| 2011/0306911 | A1 | 12/2011 | Tran |
| 2012/0004587 | A1 | 1/2012 | Nickel et al. |
| 2012/0010547 | A1 | 1/2012 | Hinds |
| 2012/0029404 | A1 | 2/2012 | Weaver, Ii et al. |

FOREIGN PATENT DOCUMENTS

| | | | |
|---|---|---|---|
| CA | 2112789 | | 8/1994 |
| CA | 2114387 | | 8/1994 |
| CH | 41765 | | 9/1907 |
| CH | 111341 | | 11/1925 |
| CH | 199766 | | 11/1938 |
| CH | 204 834 | A | 8/1939 |
| CH | 471 553 | | 6/1969 |
| CH | 523 669 | | 7/1972 |
| CH | 537 164 | | 7/1973 |
| CH | 562 015 | | 5/1975 |
| CH | 577 282 | | 7/1976 |
| CH | 612 076 | | 7/1979 |
| CH | 624 001 | | 7/1981 |
| DE | 555211 | | 7/1932 |
| DE | 641976 | | 2/1937 |
| DE | 1 661 668 | | 8/1953 |
| DE | 7043154.8 | | 3/1971 |
| DE | 7045778.2 | | 3/1971 |
| DE | 1 785 220 | | 5/1971 |
| DE | 2 062 795 | | 6/1972 |
| DE | 7047038 | | 1/1974 |
| DE | 23 41 658 | | 3/1974 |
| DE | 24 14 439 | | 10/1975 |
| DE | 29 00 077 | A1 | 7/1980 |
| DE | 29 14 280 | A1 | 10/1980 |
| DE | 31 01 952 | A1 | 9/1982 |
| DE | 81 01 488.0 | | 7/1984 |
| DE | 38 13 470 | A1 | 11/1989 |
| DE | 3822113 | C1 | 1/1990 |
| DE | 43 02 401 | A1 | 8/1994 |
| DE | 94 13 147 | U | 10/1994 |
| DE | 93 15 776.2 | | 2/1995 |
| DE | 295 03 552.8 | | 4/1995 |
| DE | 196 24 553 | A1 | 1/1998 |
| DE | 19945045 | A1 | 9/1999 |
| DE | 201 16 755 | U1 | 1/2002 |
| EP | 0 393 380 | A1 | 10/1990 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 651 954 | A1 | 5/1995 |
| EP | 0 693 260 | B1 | 1/1996 |
| EP | 0 734 662 | A1 | 10/1996 |
| EP | 1 236 412 | A | 9/2002 |
| FR | 1 349 832 | | 1/1964 |
| FR | 1 374 110 | | 10/1964 |
| FR | 1 404 799 | | 7/1965 |
| FR | 2 019 991 | A | 7/1970 |
| FR | 2 108 428 | | 5/1972 |
| FR | 2 173 451 | | 10/1973 |
| FR | 2 175 684 | | 10/1973 |
| FR | 2 399 811 | | 3/1979 |
| FR | 2 565 795 | A1 | 12/1985 |
| FR | 2 598 292 | A1 | 11/1987 |
| FR | 2 726 440 | A1 | 5/1996 |
| FR | 2 770 379 | A1 | 5/1999 |
| FR | 2 814 919 | A1 | 4/2002 |
| GB | 11673 | | 0/1899 |
| GB | 216400 | | 5/1924 |
| GB | 2 449 722 | A | 5/2007 |
| IT | 1220811 | | 3/1998 |
| IT | 2003 A 000197 | | 3/2005 |
| IT | 2003 A 000198 | | 3/2005 |
| JP | 8-9202 | | 6/1933 |
| JP | 49-28618 | | 3/1974 |
| JP | 51-2776 | | 1/1976 |
| JP | 51-121375 | | 10/1976 |
| JP | 51-131978 | | 10/1976 |
| JP | 54-108125 | | 1/1978 |
| JP | 53-124987 | | 10/1978 |
| JP | 62-57346 | | 4/1987 |
| JP | 63-80736 | | 5/1988 |
| JP | 3030988 | | 3/1991 |
| JP | 3031760 | | 3/1991 |
| JP | 7-208 | | 1/1995 |
| JP | 10-199366 | | 7/1998 |
| JP | 2004-016732 | | 1/2004 |
| JP | 2004-041666 | | 2/2004 |
| KR | 20-0367882 | | 11/2004 |
| KR | 20-0400568 | | 11/2005 |
| KR | 10-0598627 | | 7/2006 |
| WO | WO 94/27456 | | 12/1994 |
| WO | WO 95/03720 | | 2/1995 |
| WO | WO 98/37782 | | 9/1998 |
| WO | WO 99/15043 | A1 | 4/1999 |
| WO | WO 00/53045 | | 9/2000 |
| WO | WO 00/76337 | A1 | 12/2000 |
| WO | WO 01/08525 | A1 | 2/2001 |
| WO | WO 2007/016983 | A1 | 2/2007 |

OTHER PUBLICATIONS

U.S. Appl. No. 13/098,276, filed Apr. 29, 2011, including its ongoing prosecution history, James Paul Goodman et al.

U.S. Appl. No. 13/174,527, filed Jun. 30, 2011, including its ongoing prosecution history, Jesse D. Cotterman, et al.

U.S. Appl. No. 13/174,533, filed Jun. 30, 2011, including its ongoing prosecution history, Michael J. Nickel, et al.

U.S. Appl. No. 13/011,707, filed Jan. 21, 2011, including its ongoing prosecution history, Mark Kerns et al.

Ex Parte Re-Examination of U.S. Patent No. 7,591,050, Re-Exam Control No. 90/011,028, Reexamination Non-Final Office Action dated Nov. 23, 2010.

ASOLO® Boot Brochure Catalog.

International Search Report and Written Opinion for PCT/US2009/031342 dated Jul. 1, 2009.

U.S. Appl. No. 12/853,141, filed Aug. 9, 2010, including its ongoing prosecution history, Hammerslag.

Request for Ex Parte Re-Examination of U.S. Patent No. 7,591,050, Re-Exam Control No. 90/011,028, dated Jun. 11, 2010 (Request for Ex Parte Re-Examination, Information Disclosure Statement, References, Notice of Assignment of Reexamination Request).

Order Granting Request for Ex Parte Re-examination of U.S. Patent No. 7,591,050, Re-Exam Control No. 90/011,028, dated Jul. 23, 2010.

U.S. Appl. No. 08/917,056, filed Aug. 22, 1997, patented as U.S. Patent No. 5,934,599 on Aug. 10, 1999, including its prosecution history, including office communications dated Apr. 24, 1998, Nov. 9, 1998, and Mar. 18, 1999.

U.S. Appl. No. 09/337,763, filed Jun. 22, 1999, patented as U.S. Patent No. 6,202,953 on Mar. 20, 2001, including its prosecution history, including office communications dated Mar. 28, 2000, and Jul. 13, 2000.

U.S. Appl. No. 09/388,756, filed Sep. 2, 1999, patented as U.S. Patent No. 6,289,558 on Sep. 18, 2001, including its prosecution history, including office communications dated Oct. 11, 2000, Mar. 15, 2001, and May 10, 2001.

U.S. Appl. No. 09/993,296, filed Nov. 14, 2001, published as U.S. 2002-0095750 on Jul. 25, 2002, including its prosecution history, including office communications dated Dec. 20, 2002, Nov. 18, 2003, May 20, 2004, Nov. 2, 2005, and Jun. 9, 2006.
U.S. Appl. No. 10/459,843, filed Jun. 12, 2003, published as U.S. 2003-0204938 on Nov. 6, 2003, patented as U.S. Patent No. 7,591,050 on Sep. 22, 2009, including its prosecution history, including office communications dated Dec. 30, 2004, Apr. 4, 2006, Mar. 12, 2007, Dec. 13, 2007, Jul. 3, 2008, Dec. 15, 2008, and Jun. 29, 2009.
U.S. Appl. No. 11/263,253, filed Oct. 31, 2005, published as U.S. 2006-0156517 on Jul. 20, 2006, including its ongoing prosecution history, including office communications dated Jan. 15, 2008, Jun. 10, 2009, and Dec. 17, 2009.
U.S. Appl. No. 11/650,665, filed Jan. 8, 2007, published as U.S. 2007-0169378 on Jul. 26, 2007, including its prosecution history, including an office communication dated Jun. 26, 2009.
U.S. Appl. No. 11/841,872, filed Aug. 20, 2007, published as U.S. 2008-0060167 on Mar. 13, 2008, including its prosecution history.
U.S. Appl. No. 11/841,997, filed Aug. 20, 2007, published as U.S. 2008-0066345 on Mar. 20, 2008, including its ongoing prosecution history.
U.S. Appl. No. 11/842,005, filed Aug. 20, 2007, published as U.S. 2008-0083135 on Apr. 10, 2008, including its ongoing prosecution history, including an office communication dated Jun. 25, 2009.
U.S. Appl. No. 11/842,009, filed Aug. 20, 2007, published as U.S. 2008-0060168 on Mar. 13, 2008, including its ongoing prosecution history, including an office communication dated Jun. 26, 2009.
U.S. Appl. No. 11/842,013, filed Aug. 20, 2007, published as U.S. 2008-0066346 on Mar. 20, 2008, including its ongoing prosecution history.
U.S. Appl. No. 11/854,522, filed Sep. 12, 2007, published as U.S. 2008-0066272 on Mar. 20, 2008, including its ongoing prosecution history, including an office communication dated Aug. 20, 2009.
U.S. Appl. No. 12/623,362, filed Nov. 20, 2009, including its ongoing prosecution history, Mark S. Soderberg.
U.S. Appl. No. 11/070,579, filed Mar. 1, 2005, published as U.S. 2005-0198866 on Sep. 15, 2005, including its prosecution history, including office communications dated Aug. 30, 2006, and Feb. 27, 2007.
U.S. Appl. No. 09/956,601, filed Sep. 18, 2001, including its prosecution history, Gary R. Hammerslag.
U.S. Appl. No. 13/273,060, filed Oct. 13, 2011, including its ongoing prosecution history, Soderberg, et al.
U.S. Appl. No. 13/343,658, filed Jan. 4, 2012, including its ongoing prosecution history, Hammerslag, et al.
ASOLO® Boot Brochure Catalog upon information and belief date is as early as Aug. 22, 1997.
International Preliminary Report on Patentability for PCT/CA2008/000819 dated Jul. 20, 2010, which corresponds to US 2011/0099690.
Written Opinion of the International Searching Authority for PCT/CA2008/000819 dated Sep. 25, 2008, which corresponds to US 2011/0099690.
International Search Report for PCT/CA2008/000819 dated Sep. 25, 2008, which corresponds to US 2011/0099690.
International Preliminary Report on Patentability for PCT/CA2009/000044 dated Jul. 20, 2010, which corresponds to US 2011/0283440.
Written Opinion of the International Searching Authority for PCT/CA2009/000044 dated Apr. 23, 2009, which corresponds to US 2011/0283440.
International Search Report for PCT/CA2009/000044 dated Apr. 23, 2009, which corresponds to US 2011/0283440.
U.S. Appl. No. 13/614,647, filed Sep. 13, 2012, Hammerslag et al.

* cited by examiner

CLOSURE SYSTEM

PRIORITY CLAIM AND INCORPORATION BY REFERENCE

The present application claims the benefit of U.S. Provisional Patent Application No. 61/022,045, filed Jan. 18, 2008 (entitled "CLOSURE SYSTEM").

The present application incorporates by reference the entire disclosure of U.S. Provisional Patent Application No. 61/022,045, filed Jan. 18, 2008 (entitled "CLOSURE SYSTEM").

BACKGROUND OF THE INVENTION

1. Technical Field

This disclosure relates to the field of closure systems. More specifically, this disclosure relates to methods and systems of cam assembly and strap based closure systems using a spiral.

2. Description of the Related Art

A significant problem with closure systems today is that they lack a self-locking mechanism. Creating closure systems that are infinitely adjustable and self-locking is especially problematic. Moreover, creating a closure system where the torque felt by the knob is constant is especially problematic.

Another problem is that closure systems create a force that pries the cam away from the strap, which lowers the strength of the system. Yet another problem is that closure systems do not prevent the strap from completely falling out of the cam assembly when the strap is loosened.

These inventions seek to address at least some of these problems.

SUMMARY OF THE INVENTION

Some embodiments of these inventions provide a cam assembly and strap based system for bringing two sides of an article together. The system may also be used to bring multiple sides of an article together, two objects together and/or multiple objects together and/or away from each other. In some embodiments, a cam assembly and strap based closure system may use a logarithmic spiral. When the user inserts the strap into the cam assembly and turns a knob, the strap is driven into the cam assembly. In some embodiments, the pins on the strap engage the cam spirals in the cam assembly. A track insert may pull the strap away from the cam to disengage the strap so that the cam spirals are engaged in reduced number of strap pins compared to the total number of strap pins within the cam assembly.

In some embodiments, one or more logarithmic spirals cause the strap pins to always be engaged at a constant angle, often self-locking. In addition to being self-locking, the system may be infinitely adjustable and the torque felt by the knob may be constant. The contact angle between the cam and the strap may be varied as desired. In some embodiments, lower contact angles may make the system self-locking. In some embodiments, more than one spiral may be used. Different spirals, such as Archimedean spirals, may be used in some embodiments. In some embodiments, higher contact angles may allow the strap to be driven into the cam assembly more rapidly. In some embodiments, secondary frictional elements, for example detents on the bottom or periphery of the cam or buttons, may be used to make the system self-locking even at higher contact angles. In addition, a detent system may be used to provide an audible click to provide an auditory indication of movement.

In some embodiments, the system may bring the strap pins into the cam assembly and in parallel to the cam for maximum strength and then use a guide component on a track insert that bends the strap away from the cam in a deliberate and controlled way. The guide component or bend back mechanism may be a tunnel and/or can be an S-shaped bend and/or an arc that pulls the strap away from the cam spirals that drive the strap pins. In some embodiments, the center portion of a spiral may be removed to allow room for this disengagement to occur. This guide component is particularly useful in providing the lowest possible height and/or profile of the housing. The guide component may also allow the strap to be fed into the cam assembly without catching on the cam.

In some embodiments, the system may be configured to prevent or obstruct the strap from completely feeding out of the cam assembly when the knob is driving the strap out of the cam assembly. For example, in some embodiments, once the end of the strap pins are reached, the strap may ratchet in place. Keeping the strap in the cam assembly maintains the position such that the knob may be turned to immediately drive the strap back into the cam assembly. This is particularly useful for avoiding having to manually push the strap into the cam assembly to engage the cam spirals.

In some embodiments, the system may be configured to allow rapid release and/or quick insertion of the strap for faster operation. The system may be configured to allow a user to pull up on a knob against, for example, a wave washer and/or spring, to disengage the cam from the strap. When the knob is released, the cam is biased back against the strap. If the cam is not aligned with the strap pins, then once the knob is turned the strap pins are reengaged. This is particularly useful to facilitate rapid release and/or quick insertion of the strap for faster operation of the closure system. In addition, in some embodiments, the system may be detented so that the knob and/or cam can be snapped into a release position and then snapped directly downward into a position to drive the strap.

In some embodiments, quick insertion may be accomplished by providing beveled strap pins and a biasing member such as a wave washer and/or spring. When the strap is inserted into the cam assembly, the cam can hop or pass over the beveled strap pins. The hop or pass over may be facilitated when the beveled strap pins are mated to a beveled cam spiral. This is particularly useful for allowing the closure to open slowly, but also allowing rapid advancement or insertion of the strap. In some embodiments, the tension side of the strap pins may be kept at approximately 90 degrees for maximum strength and retention.

In some embodiments, the system may be configured to manage overloading forces applied to the system for strength and safety. For example, by beveling the drive side of the strap pins and cam spirals, the knob and cam can be configured to pop up and release the strap to prevent overloading of the system at a predetermined load. This is particularly useful in, for example, helmet, headwear, or other clothing or accessory applications.

In some embodiments, the system may include an adjustment memory. The cam may be infinitely adjustable and can be left in a particular position for an ideal fit for a particular use. When the user releases a gross movement mechanism, for example, a clasp, buckle, hook, or latch, the adjustment or position of the strap within the cam is memorized or retained. The gross movement mechanism may allow some slack to be generated for release and may allow the closure system to be a fine adjustment that can be retained for adjusting the strap.

The gross movement mechanism may be particularly useful, in some embodiments, for rapid release and/or quick insertion.

The system is particularly useful as a replacement for Velcro. Various applications include shoes, including zonal closures; sandals, including straps; helmets; medical braces; packs; tying down loads; protective pads, including shin guards and football pads; snowboard bindings; gloves; and belts.

In some embodiments, a cam assembly and strap based system for bringing two sides of an article together is provided. The system may include a housing adapted to receive a strap. In some embodiments, the housing includes a track insert configured to receive the strap. The strap may be adapted to feed into the housing and track insert and may include strap pins configured to engage in a cam. The cam may include at least one spiral. The cam may be configured to pull the strap pins. The system may further include a knob configured to rotate the cam.

In some embodiments, a method for drawing two objects towards each other is provided. The method may include providing a housing adapted to receive a strap. In some embodiments, the housing may include a track insert configured to receive the strap. The strap may be adapted to feed into the housing and track insert. The strap may include strap pins configured to engage in a cam. The method may further include configuring the cam to pull the strap pins, wherein the cam may include at least one spiral. The method may further include, providing a knob configured to rotate the cam. The housing, the cam, and the knob may be positioned on a first object. The strap may be positioned on a second object. The knob may be rotated to drive the strap into the housing to pull the first object and second object towards each other.

In some embodiments, a method for drawing two objects away from each other is provided. The method may include providing a housing adapted to receive a strap. In some embodiments, the housing may include a track insert configured to receive the strap. The strap may be adapted to feed into the housing and track insert. The strap may include strap pins configured to engage in a cam. The method may further include configuring the cam to pull the strap pins, wherein the cam may include at least one spiral. The method may further include, providing a knob configured to rotate the cam. The housing, the cam, and the knob may be positioned on a first object. The strap may be positioned on a second object. The knob may be rotated to drive the strap away from the housing to push the first object and second object away from each other.

Some embodiments of these inventions comprise a strap suitable for use in a cam housing, the strap useful for tightening an article, compressing an article, loosening an article, pulling two articles together, pushing two articles apart, pulling two sides of an article toward each other or pushing two sides of an article away from each other. The strap may comprise a proximal end, a distal end, spiral engaging members or strap pins near the proximal end, and between the proximal end and the first of the spiral engaging members a stop for impeding the strap's entrance into and exit from the cam housing. The stop may be configured to collapse to allow entrance into and/or exit from the cam housing given sufficient force applied to the strap in an appropriate manner. The strap may include one or more holes and one or more extensions extending in a plane with the strap such that one or more of the extensions collapse into the one or more holes to allow the strap to pass into or out of the cam housing. The extensions may alternatively extend in a plane different than the strap, for example they may extend upwards from the surface of the strap such that they, for example, contact a portion of the housing to impede the insertion of or withdrawal of the strap from the housing. These off-plane extensions would collapse substantially downward (if they extend upwards from the strap surface) or substantially upward (if they extend downward from the strap surface) to allow entrance into or exit from the housing. The one or more extensions may be angled or chamfered at their proximal and/or distal edges such that they promote some sliding with respect to the housing whereby they ultimately allow the strap to enter or exit the housing given sufficient force applied to the strap. In some embodiments, the angle or chamfer of the proximal edge of the extension less than the angle of the distal edge as measured from the edge or surface of the strap such that less force is required to compress the one or more extensions when the strap is inserted than when it is removed. Some embodiments include a chamfered surface on the first spiral engaging member wherein the angle of the chamfer is on the side of the spiral engaging member which faces the proximal end of the strap such that spirals attempting to engage this chamfered surface slide off the surface and the strap is not forced by the spirals out of the housing once all of the spiral engaging members are released from the spiral area of the housing. The leading chamfered surface may also allow for quick insertion of a strap into an appropriately configured housing. Some embodiments may comprise a stop as described above near the distal most spiral engaging member to prevent the strap from freely passing through the housing once the last or distal most spiral engaging member has passed through the spirals. This stop may be configured to completely prevent further movement of the strap through the housing, such as, for example, by including one or more outward extensions which cannot be compressed. Some embodiments may include a distal facing chamfered surface on the distal most spiral engaging member so that the spiral surface slides off of the distal most spiral engaging member once the strap has passed through the housing a pre-determined length. In some embodiments, the strap may comprise at its distal end a portion configured for attaching the distal end to an article. In some embodiments, this portion is configured as a hole for mating engagement with a hook or other device as shown, for example, in the figures. In some embodiments, the proximal end of the strap attaches to the housing while the distal end attaches to an article. In some embodiments, one or more of the spiral engaging members or strap pins include spiral engaging surfaces in substantially the same plane as one or both of the engagement surfaces of the spirals. Some embodiments of these inventions include an article having a strap with one or more of the features disclosed herein. These articles include, but are not limited to, shoes, boots, sandals, protective gear, compression straps, packs, backpacks, athletic gear, shin or other guards for various sports, gloves, hats, caps, helmets, hydration packs, etc.

Some embodiments of these inventions comprise a cam housing suitable for use with a strap, the housing useful for tightening an article, compressing an article, loosening an article, pulling two articles together, pushing two articles apart, pulling two sides of an article toward each other or pushing two sides of an article away from each other. The housing may comprise an inlet for allowing the insertion of a strap and an outlet to allow the strap to pass through the other side of the housing, wherein the inlet is on a different plane than the outlet. The housing may comprise a knob which may be coupled to one or more spirals, the knob/spiral combination configured to drive a strap through the housing in either direction. In some embodiments, the spirals are logarithmic spirals which maintain a constant contact angle with one or more portions of the strap as the strap moves into or out of the housing such that the strap is self locking in the housing, wherein the strap will not move into or out of the housing without rotation of the knob. In some embodiments, two spirals or spiral segments, three spirals or spiral segments, four spirals or spiral segments, five spirals or spiral segments or more spirals or spiral segments are included. Increasing the number of spirals or spiral segments increases the amount of strap that is taken into or pushed out of the housing per rotation of the spirals or spiral segments. The housing may comprise a strap pathway that insulates the strap from the article as the strap passes through the housing, the strap pathway comprising a floor near the bottom of the housing (closest to the article) on and/or over which the strap moves as it passes through the housing. The housing may comprise an insert separately formed from the housing which, when coupled to the housing, directs a strap entering the housing through the housing inlet, off the plane of the inlet, and toward the outlet of the housing which is on a different plane than the inlet. In some embodiments, the insert may be integrally formed with the housing rather than separately formed. In some embodiments, the housing comprises a knob coupled to one or more spirals, the knob configured to be displaced away from and back toward the housing to permit rapid insertion or release of a strap. In some embodiments, the housing and/or the knob include a detent or other member to hold the knob either away from or against or adjacent the housing. In some embodiments, the housing includes a biasing member which biases the knob and the spirals against or adjacent the housing. In some embodiments, the housing includes a detent or other member configured to hold the knob away from the housing against a bias. Some embodiments of these inventions include an article having a cam housing with one or more of the features described herein. These articles include, but are not limited to, shoes, boots, sandals, protective gear, compression straps, packs, backpacks, athletic gear, shin or other guards for various sports, gloves, hats, caps, helmets, hydration packs, etc.

Some embodiments of these inventions comprise a cam housing and a strap, the housing and the strap in combination useful for tightening an article, compressing an article, loosening an article, pulling two articles together, pushing two articles apart, pulling two sides of an article toward each other or pushing two sides of an article away from each other. In some embodiments, the cam housing comprises one or more of the features described herein. In some embodiments, the strap comprises one or more of the features described herein. Some embodiments are configured such that as the strap passes through the housing, it does not double up over itself. As such, in some embodiments there is only one layer of strap before engagement and during engagement of the cam housing and the strap. In some embodiments, the housing is attached to a portion of an article to be manipulated and not to the strap itself. In some embodiments, the strap and housing do not form a complete ring when engaged with a first end of the strap engaged with the housing and a second end of the strap remaining separate from the housing. In some embodiments, the housing does not ride on the strap. Some embodiments of these inventions include an article having a cam housing and a strap with one or more of the features described herein. These articles include, but are not limited to, shoes, boots, sandals, protective gear, compression straps, packs, backpacks, athletic gear, shin or other guards for various sports, gloves, hats, caps, helmets, hydration packs, etc.

Some embodiments of these inventions include a method of tightening an article, compressing an article, loosening an article, pulling two articles together, pushing two articles apart, pulling two sides of an article toward each other or pushing two sides of an article away from each other using a cam housing and a strap. In some embodiments, the cam housing comprises one or more of the features described herein. In some embodiments, the strap comprises one or more of the features described herein. In some embodiments, the combination of the cam housing and the strap comprise one or more of the features described herein. In some embodiments, the method comprises the step of turning a knob attached to the housing to drive the strap through the housing. Turning the knob causes one or more engagement surfaces of one or more spirals coupled to the knob to slidingly couple to one or more engagement surfaces of one or more spiral engaging members or strap pins on the strap, the sliding coupling pulling the strap into the housing or pushing the strap out of the housing causing tightening or compression of an article, loosening of an article, pulling two articles together, pushing two articles apart, pulling two sides of an article toward each other or pushing two sides of an article away from each other. In some embodiments, the method further comprises the step of first inserting the proximal end of the strap into the housing, wherein the strap has a stop near the proximal end which provides resistance making it relatively difficult to insert the strap into the housing such that an engagement surface on the first spiral engagement member can contact an engagement surface of one of the spirals inside the housing. The method including the strap being inserted into the housing with sufficient force to overcome the stop to bring the spiral engaging members into contact with the spirals inside the housing. In some embodiments, the knob is pulled away from the housing to allow easy insertion or removal of the strap. In some embodiments, the knob is movably biased toward the housing such that upon insertion of a strap into the housing, the strap comprising a chamfered surface on the leading or proximal most spiral engaging member causes the knob, and thereby any spirals coupled to the knob, to temporarily displace away from the housing to allow the strap to enter into the housing wherein the strap is in position to be pulled further into the housing by rotation of the knob after the knob moves back toward the housing. In some embodiments, these methods are used with respect to, for example, shoes, boots, sandals, protective gear, compression straps, packs, backpacks, athletic gear, shin or other guards for various sports, gloves, hats, caps, helmets, hydration packs, etc.

Neither this summary nor the following detailed description purports to define the inventions. These inventions are defined by the claims.

BRIEF DESCRIPTION OF THE DRAWINGS

These and other features will now be described with reference to the drawings summarized below. These drawings and the associated description are provided to illustrate some embodiments of the inventions, and not to limit the scope of the inventions.

FIGS. 11A, 11B, 11C, 1D, 11E, and 11F illustrate a flowchart of the engagement of the strap pins of FIG. 4A with the cam spirals of FIG. 3C when the strap of FIG. 1 is being driven out of the cam assembly of FIG. 1, in accordance with some embodiments of the inventions.

DETAILED DESCRIPTION OF THE PREFERRED EMBODIMENT

Numerous technical details are set forth in this description. These details are provided to illustrate some embodiments of the inventions, and are not intended to limit the inventions. Thus, nothing in this detailed description is intended to imply that any particular feature, characteristic, or component of the disclosed system is essential to the inventions.

Figure 1:
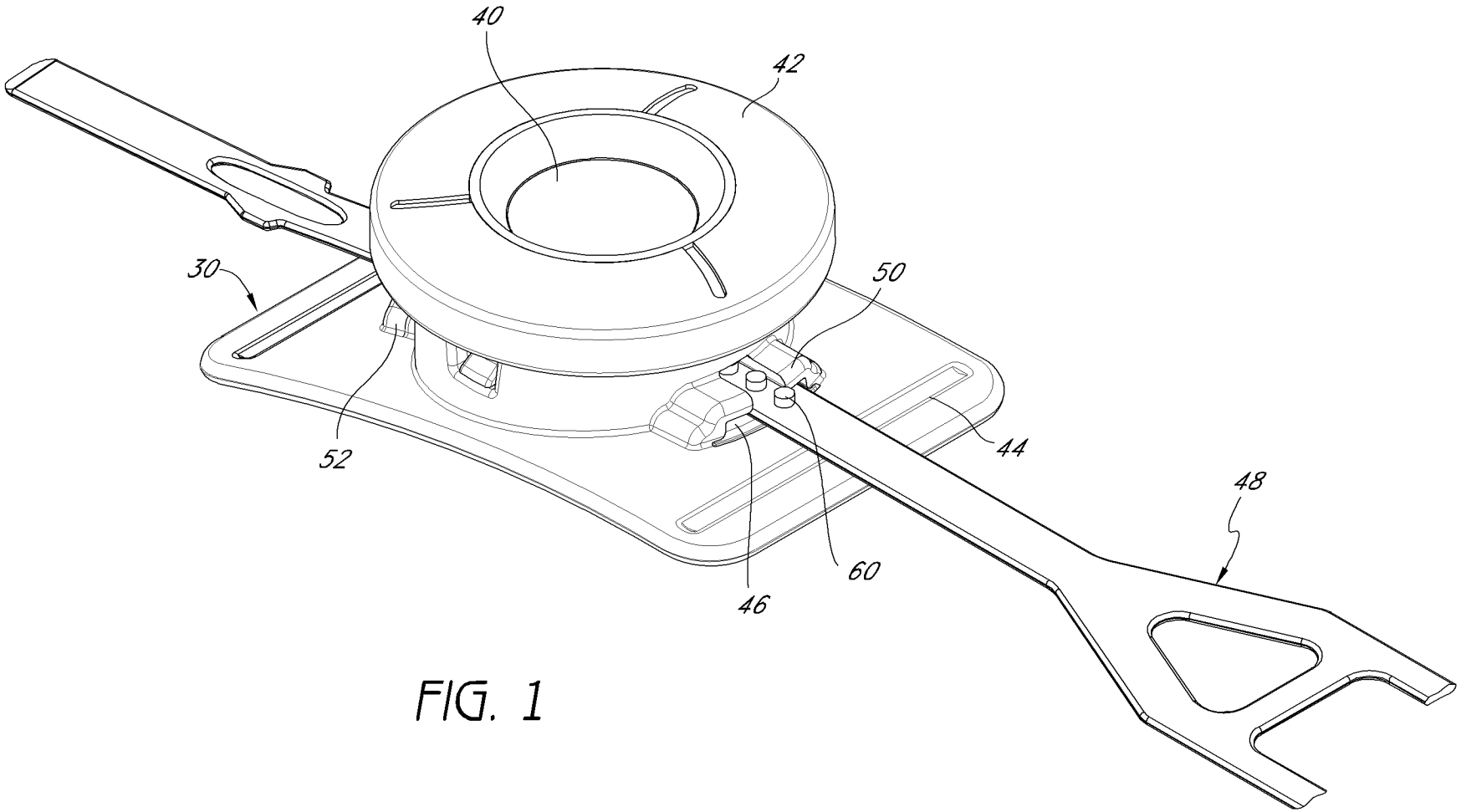
FIG. 1 illustrates a set of components for implementing a cam assembly and strap based closure system using a spiral from a perspective view, in accordance with some embodiments of the inventions.

FIG. 1 illustrates a set of components for implementing a cam assembly and strap based closure system using a spiral from a perspective view, in accordance with some embodiments of the inventions. As depicted in this drawing, a cam assembly 30 may comprise housing 44, a knob 42, a cam 40, and a track insert 46. The cam assembly 30 and housing 44 may be adapted to receive a strap 48. The term "strap" is meant to define a broad term as well as its ordinary meaning. Likewise, the term "cam assembly" is meant to define a broad term as well as its ordinary meaning. The cam assembly 30 and strap 48 may be made from numerous materials including various plastics, metals, composites, polymers, and alloys. In the illustrated embodiment, the housing 44 has a track insert 46 positioned inside the housing 44. The track insert 46 may be adapted to allow a strap 48 to move in both an inwards and outwards direction. The housing 44 has a first opening 50 and a second opening 52, which may be configured to receive a strap 48 moving in both an inwards and outwards direction as well. In some embodiments, the track insert 46 may be integrally formed with the housing 44.

As further depicted in FIG. 1, the cam assembly 30 has a knob 42 and a cam 40. In some embodiments, once the cam 40 has been correctly positioned, and the knob 42 is positioned over the cam 40, the two can be snapped together using a locking mechanism. Alternatively, the cam 40 and knob 42 may be adhered together, stitched together, divided into three or more components, be a single component, or use other attachment means.

The strap 48 may comprise one or more strap pins 60. In some embodiments the strap pins 60 may be a pointed piece of wood, metal, or plastic. In some embodiments the strap pins 60 may be a short rod. In some embodiments, the strap pins 60 may be projections, teeth grooves, channels, and/or other variations and combinations.

Figure 2A:
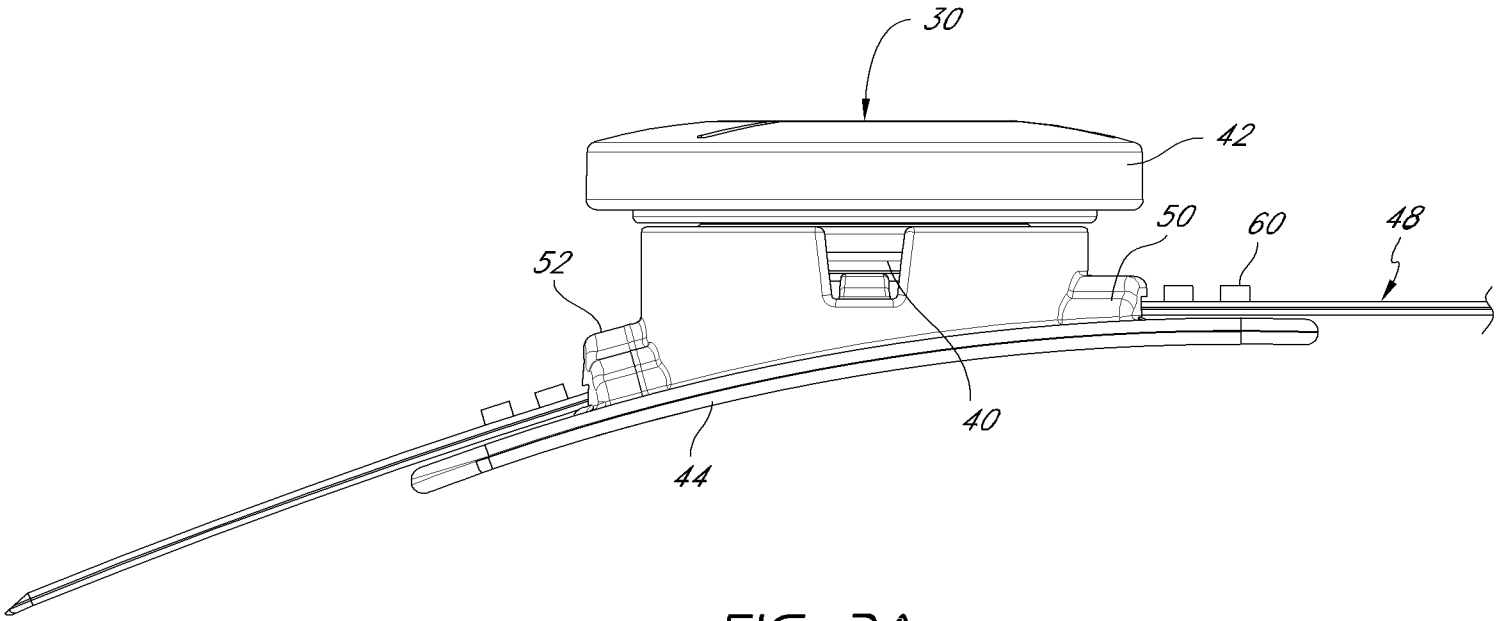
FIGS. 2A, 2B, and 2C illustrate the cam assembly and strap based closure system of FIG. 1 from a side, top, and bottom view, in accordance with some embodiments of the inventions.
Figure 2B:
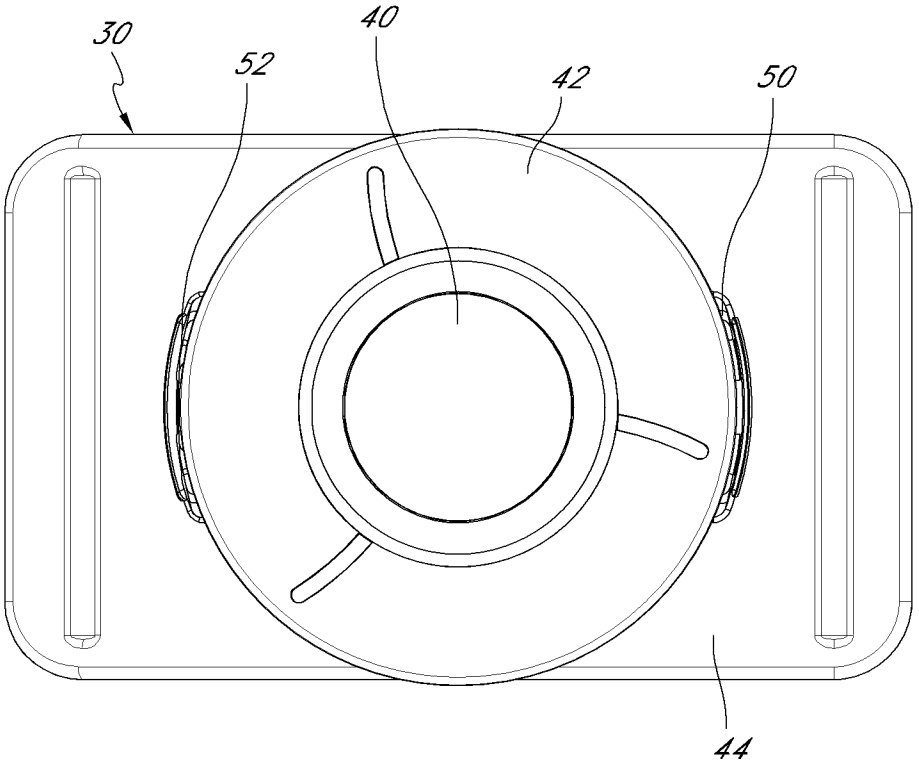
Figure 2C:
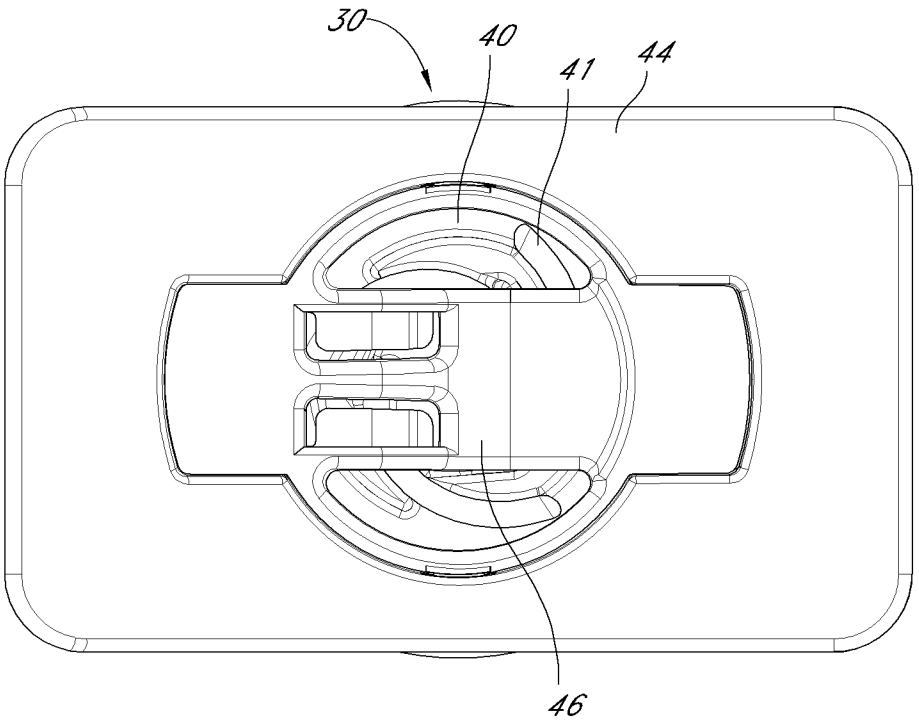

FIGS. 2A, 2B, and 2C illustrate the cam assembly 30 and strap 48 based closure system of FIG. 1 from a side, top, and bottom view, in accordance with some embodiments of the inventions. As depicted in the side view of the FIG. 2A, by rotating the knob 42 in one direction the strap 48 can be pulled into the cam assembly 30 through the first opening 50, onto the track insert 46 (not visible from this view), through the second opening 52, and out of the housing 44. As further depicted in FIG. 2A, by rotating the knob 42 in another direction the strap 48 can be pulled back through the track insert 46 (not visible from this view), through the first opening 50, and out of the housing 44. The strap 48 is driven through the cam assembly 30 when the strap pins 60 engage with the cam 40.

As further depicted in the top view of FIG. 2B, in some embodiments the cam 40 sits inside the knob 42. The knob 42 may then be rotated to drive the strap 48 through the first opening 50 into the cam assembly 30, and out the second opening 52.

As depicted in the bottom view of FIG. 2C, in some embodiments, the track insert 46 is positioned to sit inside the housing 44. The cam 40 is then positioned to sit above the track insert 46 on top of the housing 44. The cam may include one or more cam spirals 41 that cause the strap pins 60 on a strap 48 to be pulled through the cam assembly 30.

FIGS. 3A, 3B, 3C, and 3D illustrate the cam 40 of FIG. 1 from a top, bottom, and perspective views, in accordance with some embodiments of the inventions. As depicted in the top view of FIG. 3A, the cam may have a crown 47 that may be placed in one or more channels or grooves on the knob 42 that are fitted to the cam 40, and allow the cam 40 to attach to the knob 42. In some embodiments, once the cam 40 has been correctly positioned, and the knob 42 is positioned over the cam 40, the two are configured to be snapped together using a locking mechanism. Alternatively, the cam 40 and knob 42 may be adhered together, divided into three or more components, or be a single component.

Figure 3B:
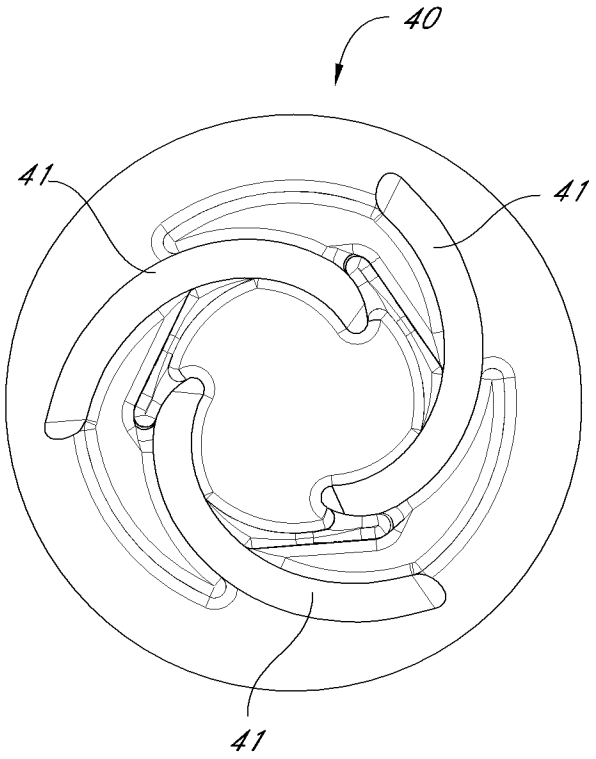
FIGS. 3A, 3B, 3C, and 3D illustrate the cam of FIG. 1 from a top, bottom, and perspective views, in accordance with some embodiments of the inventions.
Figure 3A:
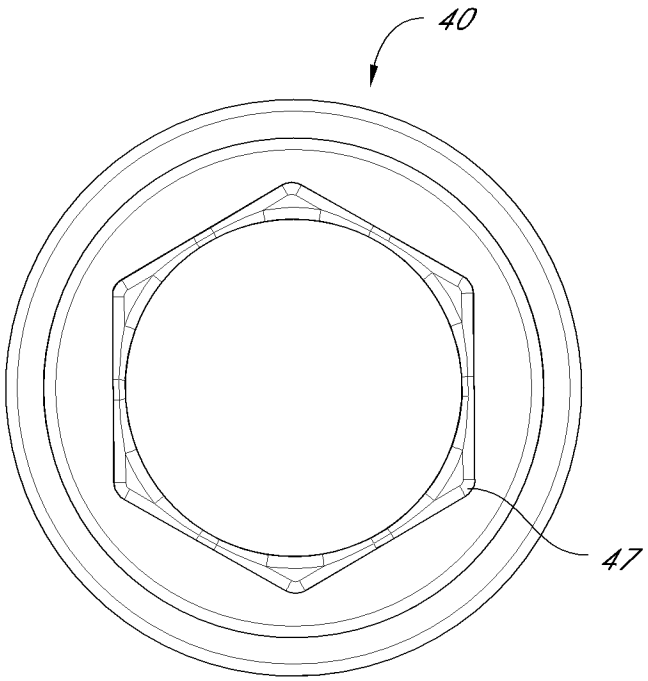
Figure 3D:
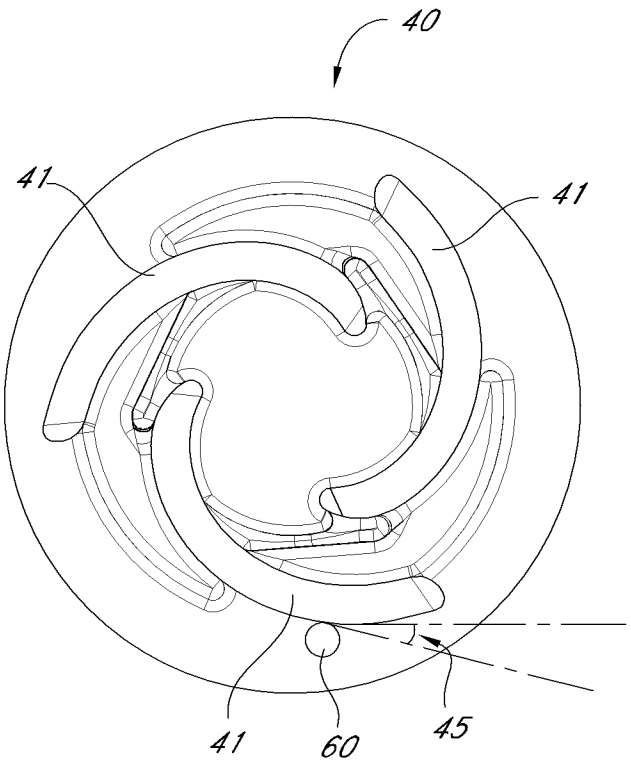
Figure 3C:
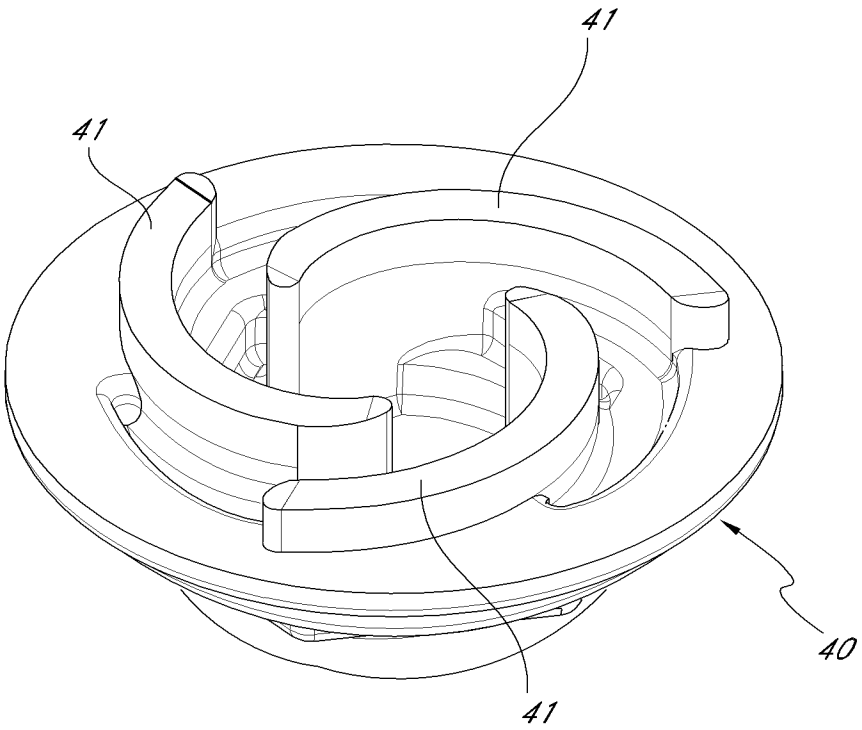

As further depicted in the bottom and perspective views of FIGS. 3B and 3C, in some embodiments, the cam 40 contains one or more cam spirals 41. The knob 42 may then be rotated to drive the strap 48 through the first opening 50 into the cam assembly 30, and out the second opening 52. In some embodiments, the cam spirals 41 are in the shape of logarithmic spirals, also known as equiangular spirals. In some embodiments, other types of spirals may be used, including Archimedean spirals. In some embodiments, two, three, four, or more cam spirals 41 may be used. Increasing the number of cam spirals 41 may be used to increase the speed at which the strap 48 is inserted. This may be particularly useful for applications where the closure is large.

The use of cam spirals 41 may allow the strap 48 to self-lock into the cam assembly 30 at certain contact angles. Logarithmic spirals may allow the strap pins 60 on the strap 48 to be pulled at a linear velocity and constant contact angle. Different materials may also be used to vary the friction coefficients and make the system self-locking. Self-locking may allow the strap 48 to remain in the same position in the cam assembly 30 when outwards forces and/or inwards forces are applied to the cam 40 and/or strap 48. When logarithmic cam spirals are used, a constant angle of contact may be maintained with the strap pins 60 on the strap 48, resulting in a self-locking system that may be infinitely adjustable, and one where the torque felt by the knob 42 may be constant. However, an Archimedean spiral may be used to vary the contact angle, such as by continuously decreasing it.

The self-locking mechanism may be determined by the contact angle 45 and the friction applied to the circumference of the cam spirals 41 on the cam 40. The contact angle 45 may correspond to an angle between lines tangent to a strap pin 60 and a cam spiral 41. In some embodiments, the contact angle 45 of a self-locking mechanism may be less than approximately 20 degrees, and less than approximately 15 degrees. In some self-locking embodiments, the contact angle is between approximately 10 and approximately 12 degrees. Low contact angles may allow the cam assembly 30 to be self-locking and continually adjustable both inwards and outwards. Various contact angles can be generated depending on the speed of wind and power desired. Larger contact angles 45 may result in faster insertion speed. Other secondary frictional elements can also be added to resist the turning of the cam 40. In some embodiments, these secondary frictional elements may be "stepless" to maintain infinite variability of position.

Figure 4A:
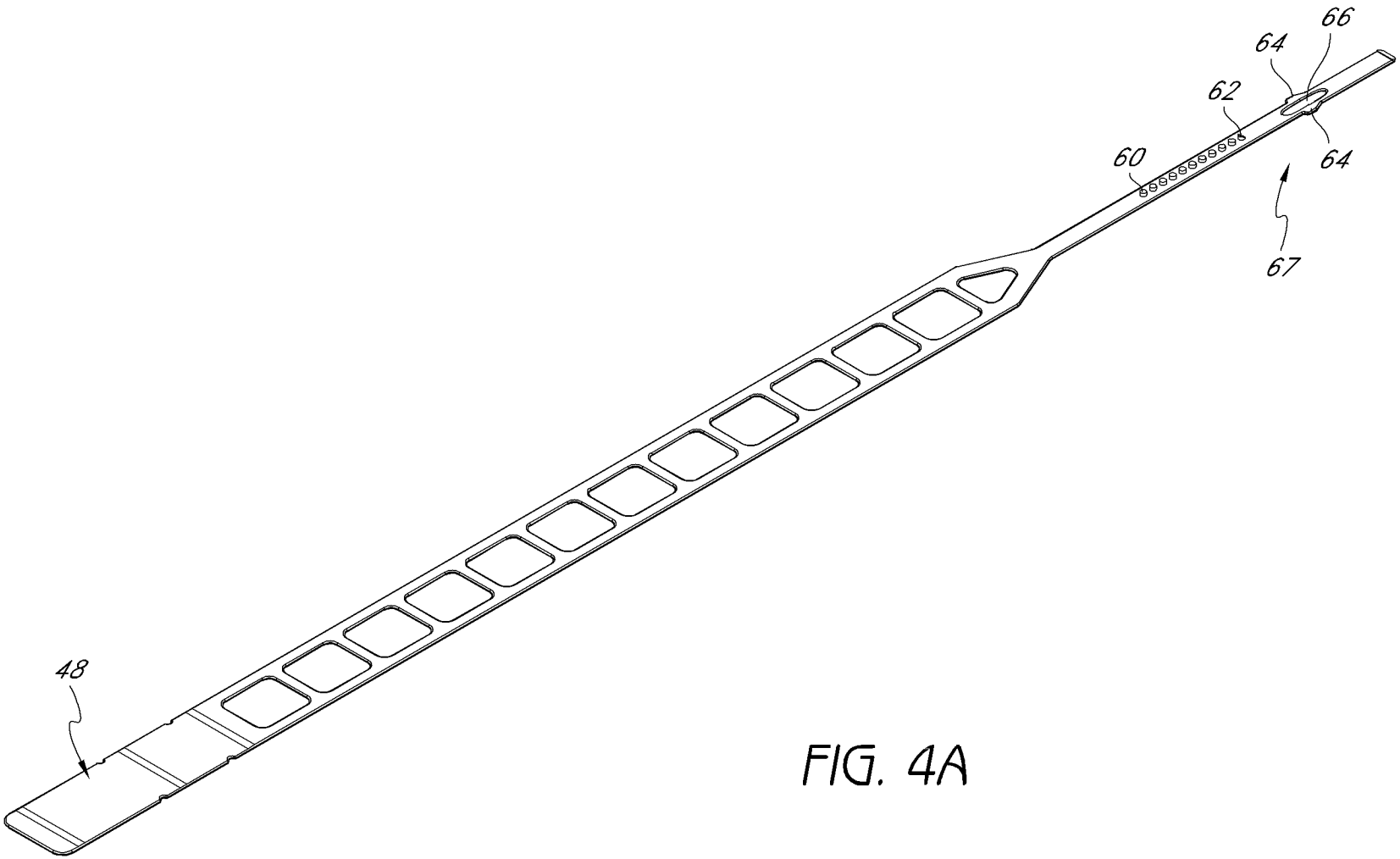
FIGS. 4A and 4B illustrate the strap of FIG. 1 from a perspective and top view, in accordance with some embodiments of the inventions.
Figure 4B:
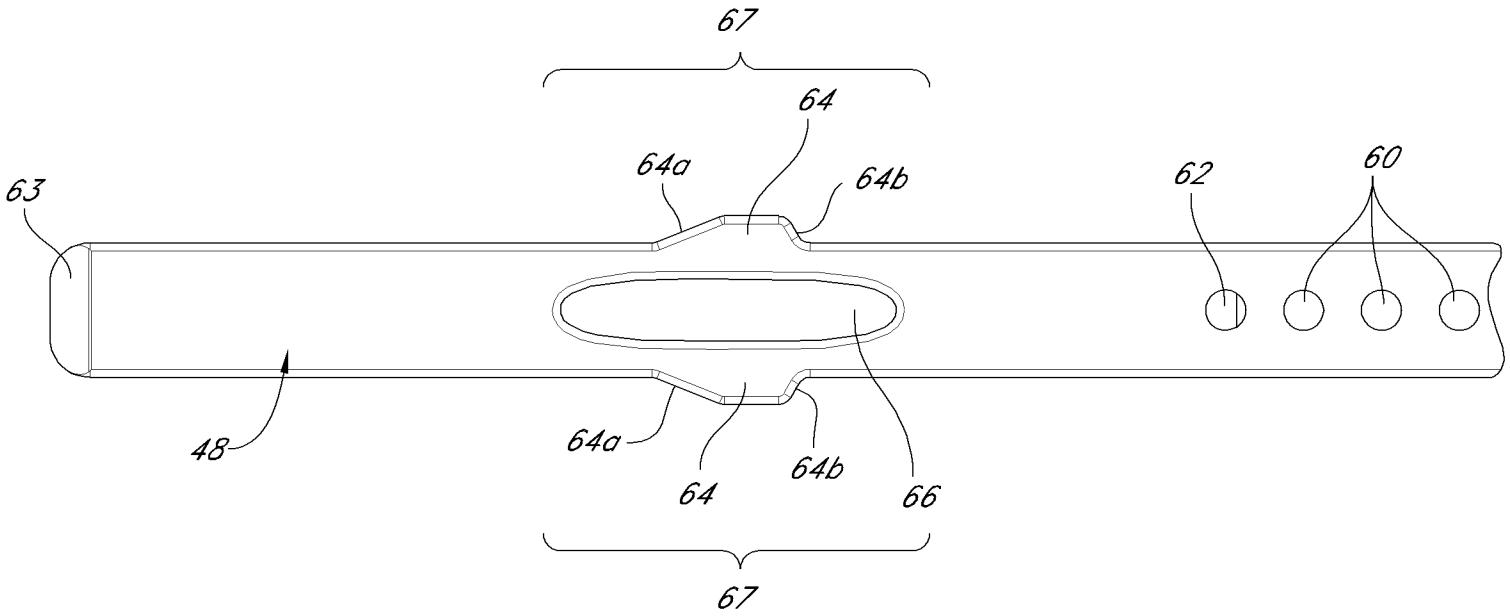

FIGS. 4A and 4B illustrate the strap 48 of FIG. 1 from a perspective and top view, in accordance with some embodiments of the inventions. The strap 48 comprises one or more strap pins 60. The strap pins 60 may be in the shape of cylinders extending from the surface of the strap 48 as illustrated. In some embodiments, the strap pins 60 may be other shapes including but not limited to rivets, teeth, threads, spirals, spiral threads, slots, strips, channels, and/or grooves that may be perpendicular or at other angles to the strap 48. In some embodiments, the cam 40 may have cam spirals 41 in complementary form and/or surfaces that may be complementary or correspond to the shape of the strap pins 60.

In some embodiments, the strap 48 may have a chamfer 62 on the first strap pin closest to the cam assembly insertion end 63, to allow the first strap pin to skip past the cam 40. The chamfer 62 may be at a range of angles, including approximately 45 degrees. The chamfer 62 may also maintain engagement between the cam 40 and the strap 48 to ensure that they continue to function. In some embodiments, a chamfer 62 may be on other strap pins 60, including the last strap pin furthest from the cam assembly insertion end 63 of the strap 48. In some embodiments, a chamfer 62 may be included on the last strap pin, in addition to, or in lieu of, being on the first strap pin.

In some embodiments, the chamfer 62 on the last strap pin may face the opposite direction of the chamfer 62 on the other strap pins. The chamfer 62 on the last strap pin may prevent the cam spirals 41 from pulling the strap 48 further into the cam assembly 30. In some embodiments, the chamfer 62 on the first strap pin, may keep the strap 48 from being pushed any further out of the cam assembly 30 and/or the chamfer 62 on the last strap pin may prevent the strap 48 from being pulled any further into the cam assembly 30.

In some embodiments, the hard stop 67 described in greater detail below, may be used as an alternative to the chamfer 62 and/or in combination with the chamfer 62. In some embodiments, the hard stop 67 may be located near the first strap pin and/or last strap pin. In some embodiments, the hard stop 67 may not include a hole 66 when used in conjunction with the chamfer 62 on the last strap pin. In some embodiments, this may prevent the strap 48 from compressing and entering into the cam assembly 30 regardless of the pressure applied to the strap 48.

As further depicted in FIGS. 4A and 4B, the strap 48 has a cam assembly insertion end 63 which is the end of the strap 48 that is inserted directly into the cam assembly 30. The strap 48 may be configured to resist being completely removed from the cam assembly 30 after insertion. In some embodiments, this resistance may be provided by a hard stop 67. In some embodiments, the hard stop 67 may be a variable stop that may be overcome given enough force. In some embodiments, the hard stop 67 may be placed near the first strap pin, the last strap pin, near other strap pins and/or multiple hard stops may be used.

The hard stop 67 may include a hole 66 and one or more outward projections 64. The hole 66 may allow the outward projections 64 to compress toward the axial center line of the strap 48 to allow the strap 48 to be inserted into the housing 44 of the cam assembly 30. Gently tapered leading edges 64*a* allow the strap 48 to enter the housing 44 with relative ease. More steeply tapered trailing edges 64*b* make it more difficult to remove the strap 48 from the housing 44. In some embodiments, the trailing edge 64*b* may catch the strap 48 on the housing 44 to prevent the strap from falling out of the housing 44 and may leave the strap 48 in a position to be pulled back in, i.e. in a position such that the first strap pin is in a position to be engaged by the cam spirals 41 as soon as the knob 42 is rotated in the tightening direction. In some embodiments, if enough force is used to pull the strap 48 out of the housing 44 the outward projections 64 can temporarily collapse into the hole 66 and the strap 48 may be removed.

Figure 5A:
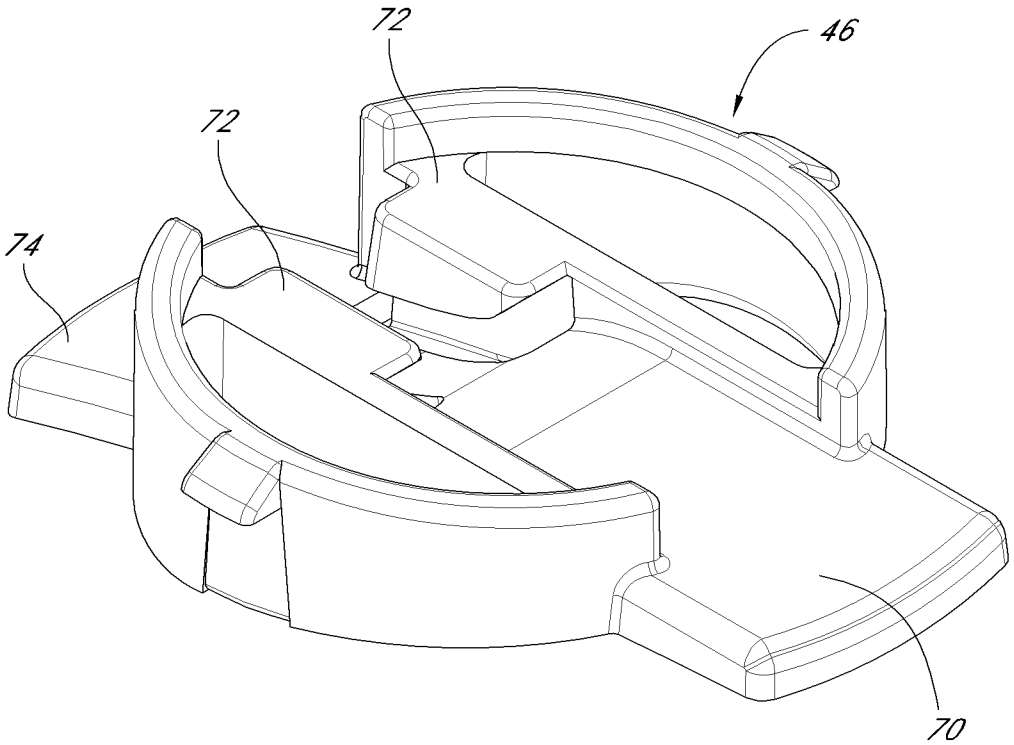
FIGS. 5A, 5B, and 5C illustrate the track insert of FIG. 1 from a perspective, top, and side view, in accordance with some embodiments of the inventions.
Figure 5C:
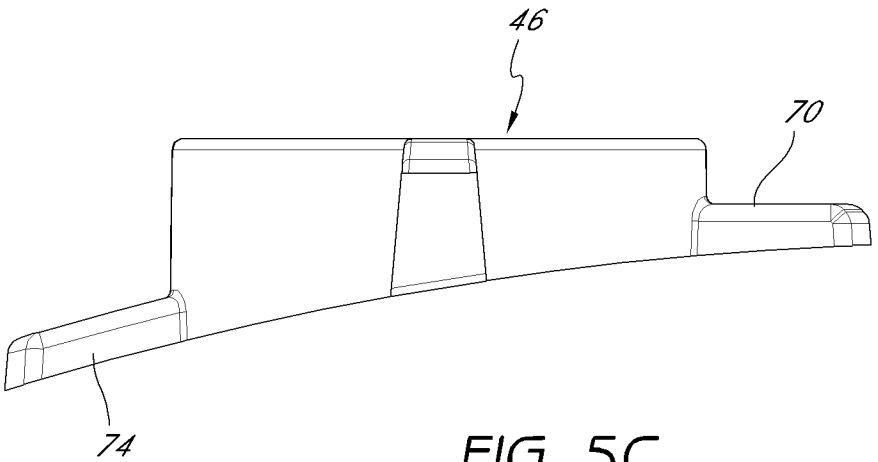
Figure 5B:
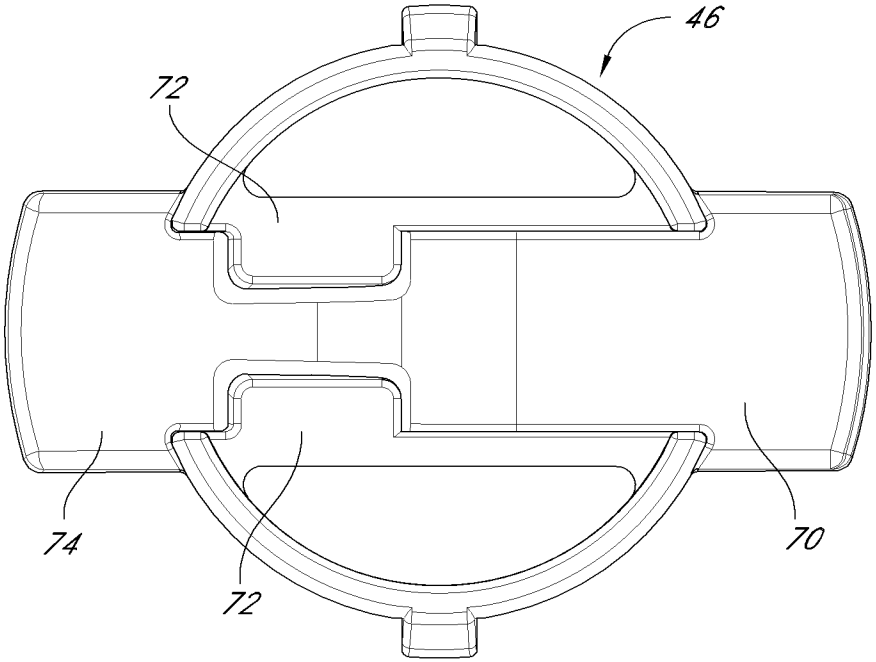
Figure 6A:
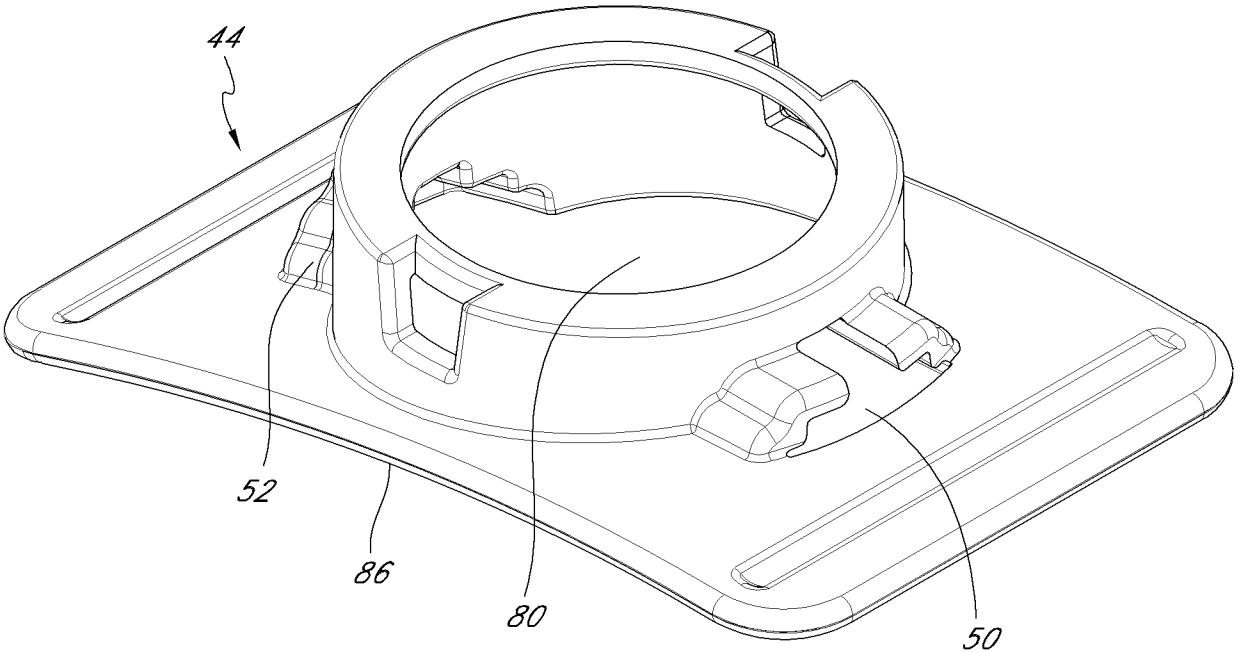
FIGS. 6A, 6B, 6C, and 6D illustrate the housing of FIG. 1 from a perspective, side, top, and bottom view, in accordance with some embodiments of the inventions.
Figure 6B:
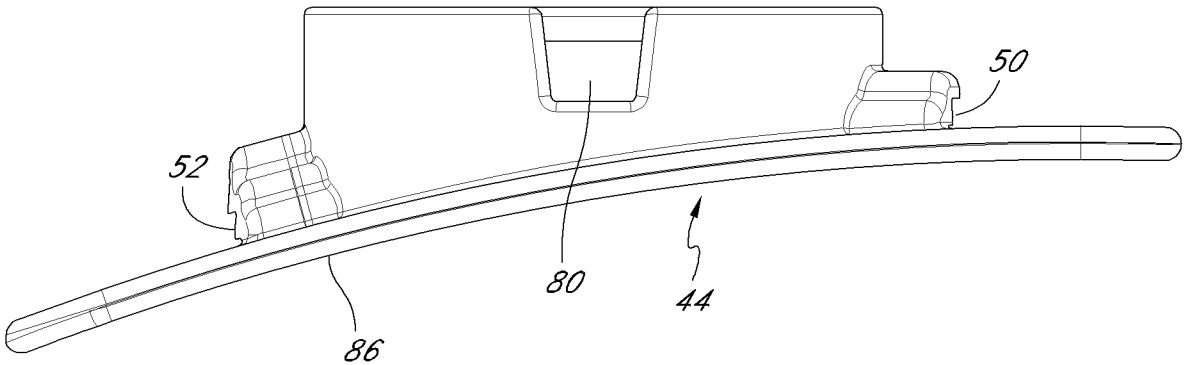
Figure 6C:
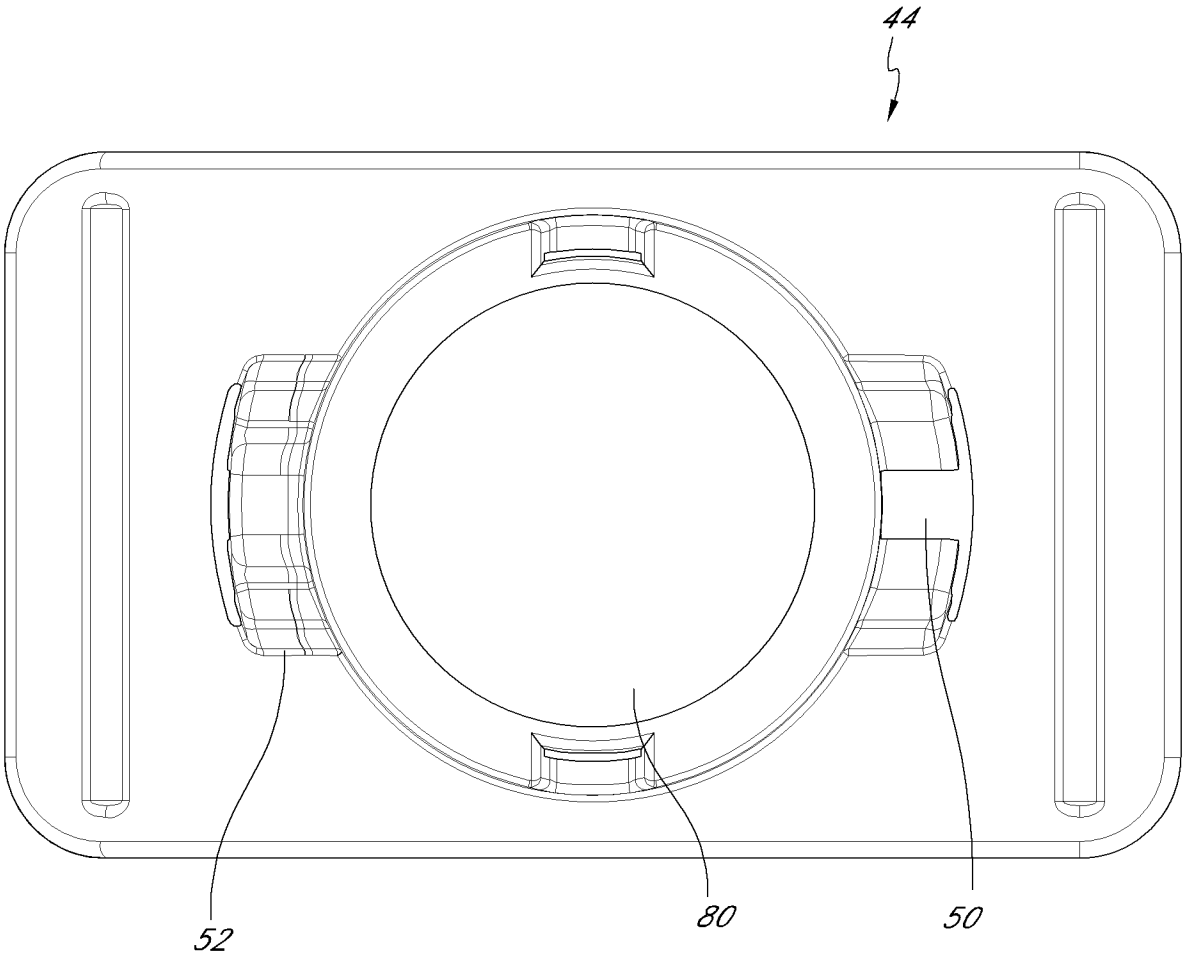
Figure 6D:
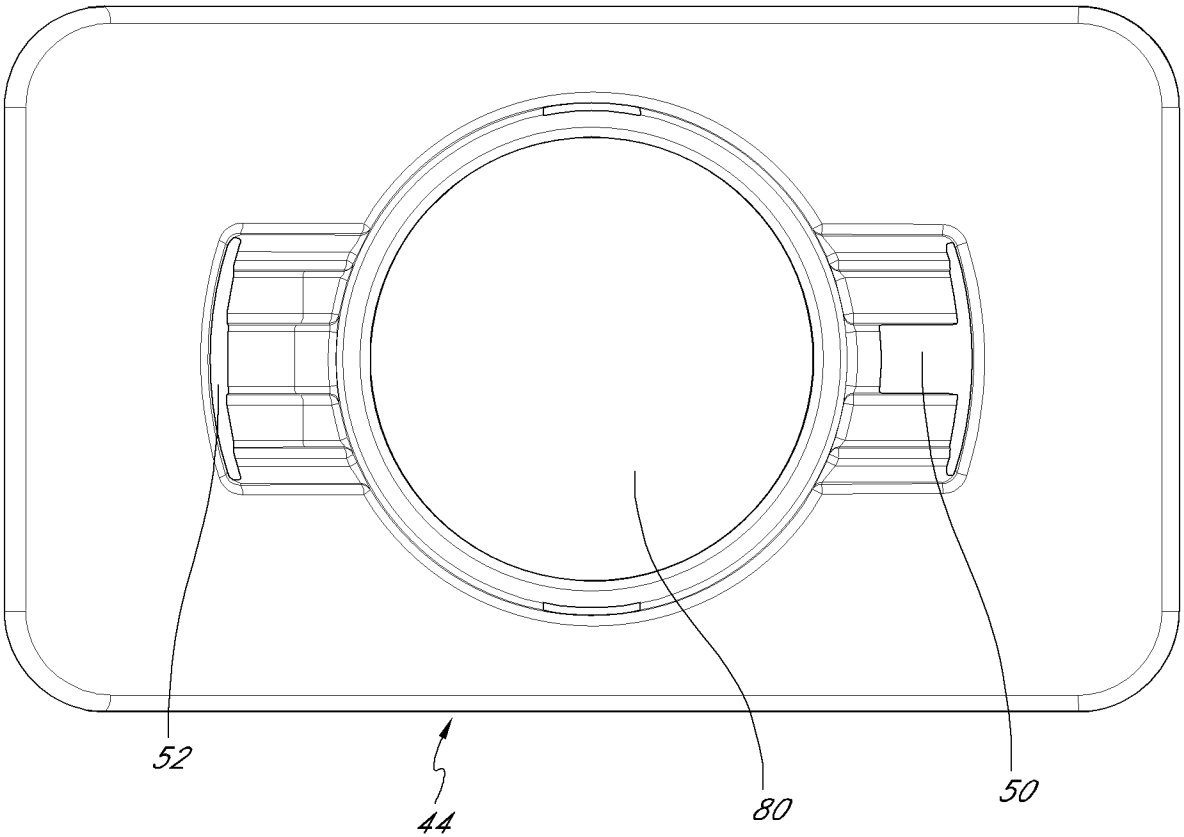

FIGS. 5A, 5B, and 5C illustrate the track insert 46 of FIG. 1 from a perspective, top, and side view, in accordance with some embodiments of the inventions. The track insert 46 has a tunnel 72 that pulls the strap 48 away from the cam 40 as it is passed through the tunnel 72. In some embodiments, the track insert guides the strap 48 along and engages the strap 48 with the cam 40 along a front edge 70 but then disengages the strap on the back edge 74. In some embodiments, the track insert 46 pulls the strap 48 away from the cam 40 so that the cam spirals 41 are engaged in a reduced number of the strap pins 60 on the strap 48 relative to the number of strap pins 60 within the housing 44. In some embodiments, the number of strap pins 60 engaged at any given time is one or two. This guide component or bend back mechanism may be a tunnel and/or S-shape bend and/or an arc which allows the strap pins 60 to disengage the cam spirals 41 of the cam 40. In some embodiments, the strap pins 60 are guided away from the cam spirals 41 such that fewer than all of the cam spirals 41 engage the strap pins 60 when the strap 48 extends through the housing 44.

In some embodiments, the guide component pulls the strap 48 away from the cam 40 so that the strap pins 60 do not engage on the backside of the cam 40. In some embodiments, the guide component prevents the system from locking up and/or may strengthen the system by bringing the strap in parallel to the cam 40 for maximum holding strength. In some embodiments, the load placed on the cam assembly 30 by the strap 48 may be a shear load, which places a stress parallel or tangential to the cam assembly 30. The guide component is particularly useful in providing the lowest possible height and/or profile of the housing 44. The guide component may also allow the strap 48 to be fed into the cam assembly 30 without catching on the cam 40.

FIGS. 6A, 6B, 6C, and 6D illustrate the housing 44 of FIG. 1 from a perspective, side, top, and bottom view, in accordance with some embodiments of the inventions. The housing 44 has a first opening 50 and a second opening 52, which are configured to receive a strap 48 moving in both an inwards and outwards direction. In the illustrated embodiment, the housing also has a circular opening 80, which allows the track insert 46 to be positioned inside the housing 44. The circular opening 80 need not be in the shape of a circle, and may be in the form of other shapes including a square, oval, or triangle. In some embodiments, the cam 40 and the knob 42 may be attached to each other, using a locking mechanism, an adhesive or any other attachment mechanism or method known to those of skill in the art. The knob 42 and cam 40 are then positioned in the circular opening 80 of the housing 44, to sit above the track insert 46 and on top of the housing 44. The knob 42 may then be rotated to drive the strap 48 through the first opening 50, onto the track insert 46, and out the second opening 52 of the housing 44.

As further depicted in FIGS. 6A, 6B, 6C, and 6D, in some embodiments, the housing 44 has a bend 86 that may be an S-shape bend and/or an arc. The bend 86 may match the shape of the bend back mechanism of the track insert 46. The bend 86 is particularly useful in providing the lowest possible height and/or profile of the housing 44. In some embodiments, the shape of the housing 44 may be adjusted based on the application. In some embodiments, the shape of the housing 44 may be flatter or more curved than an S-shape or an arc.

Figure 7:
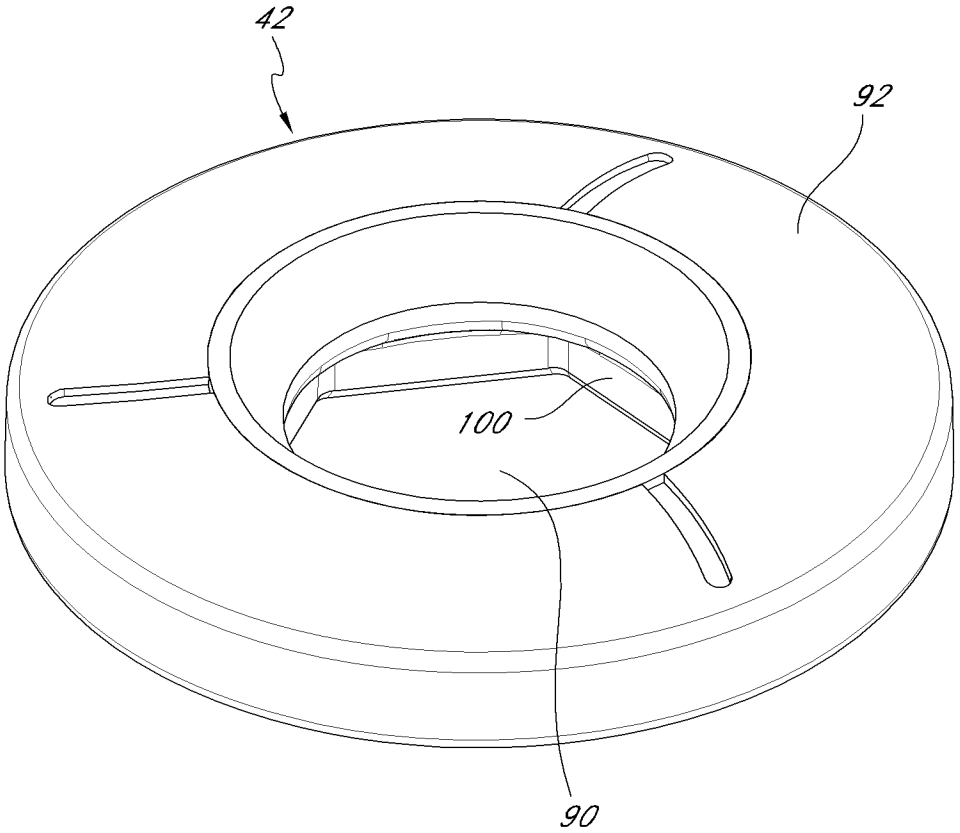
FIG. 7 illustrates the knob of FIG. 1 from a perspective view, in accordance with some embodiments of the inventions.

FIG. 7 illustrates the knob 42 of FIG. 1 from a perspective view, in accordance with some embodiments of the inventions. The knob 42 has an overmold 92 and an undermold 100. In some embodiments, once the undermold 100 has been correctly positioned, and the overmold 92 is positioned over the undermold 100, the two can be snapped together using a locking mechanism. Alternatively, the undermold 100 and overmold 92 may be adhered together, divided into three or more components, or be a single component.

As further depicted in FIG. 7, in some embodiments, the knob 42 has a cam opening 90. The cam opening 90 allows the cam 40 to sit inside the knob 42. The cam opening 90 need not be any particular shape, and may be in the form of any shape including a circle, square, oval, or triangle. Once assembled, the knob 42 may be rotated to drive the strap 48 through the first opening 50, into the cam assembly 30, and out the second opening 52.

Figure 8:
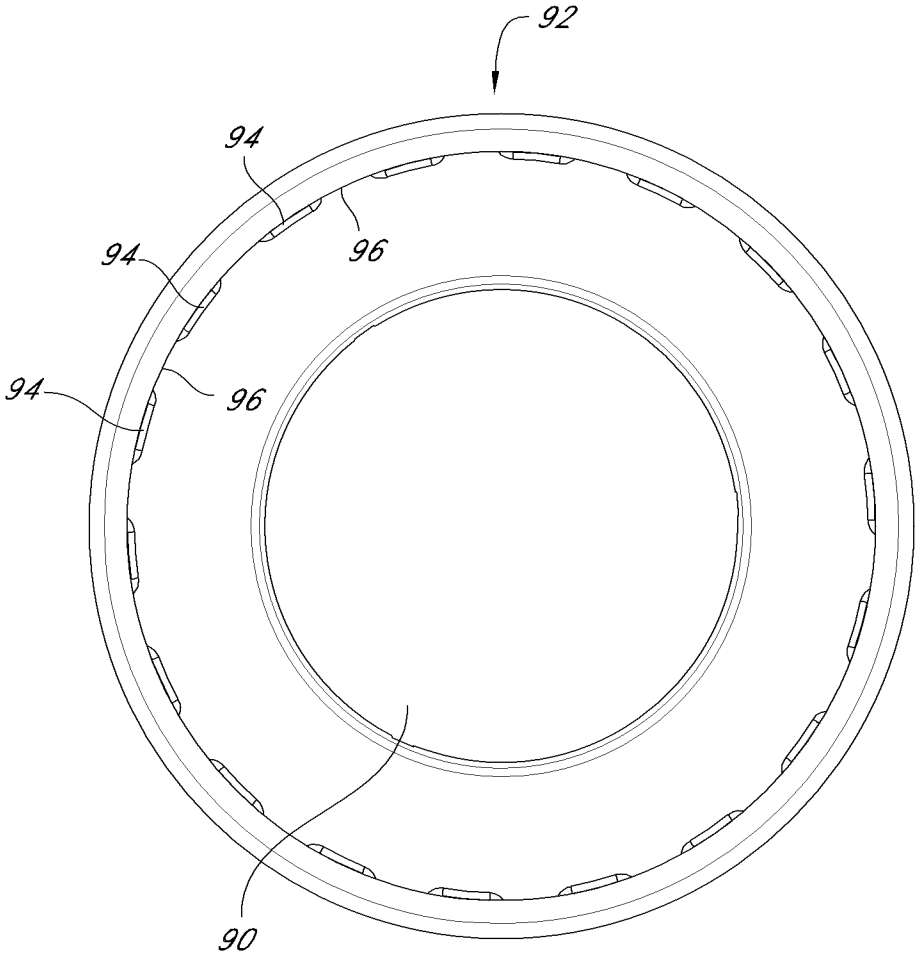
FIG. 8 illustrates the overmold of the knob of FIG. 7 from a bottom view, in accordance with some embodiments of the inventions.

FIG. 8 illustrates the overmold 92 of the knob of FIG. 7 from a bottom view, in accordance with some embodiments of the inventions. In some embodiments, the overmold 92 also has one or more overmold teeth 94. In this embodiment, the overmold teeth 94 allow the overmold 92 and the undermold 100 to be snapped together and unitized when the undermold 100 has corresponding teeth that fit in the one or more overmold grooves or channels 96 of the overmold 92. In some embodiments, the overmold 92 has a cam opening 90, which may allow different designs or colors to be used. As with the other cam openings, it may be in the form of any shape including a circle, square, oval, or triangle. In some embodiments, the overmold 92 does not include the cam opening 90.

Figure 9B:
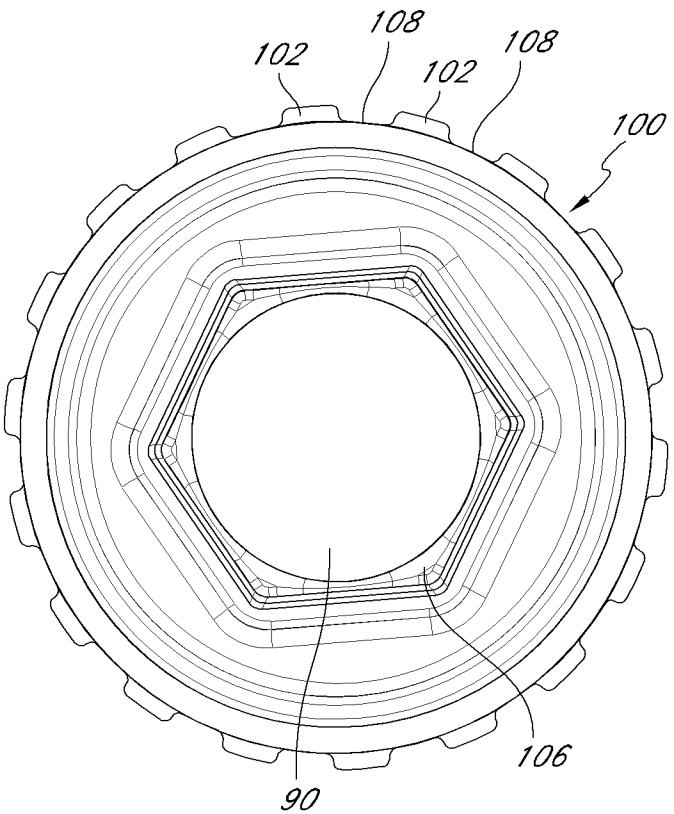
FIGS. 9A and 9B illustrate the undermold of the knob of FIG. 7 from a perspective and bottom view, in accordance with some embodiments of the inventions.
Figure 9A:
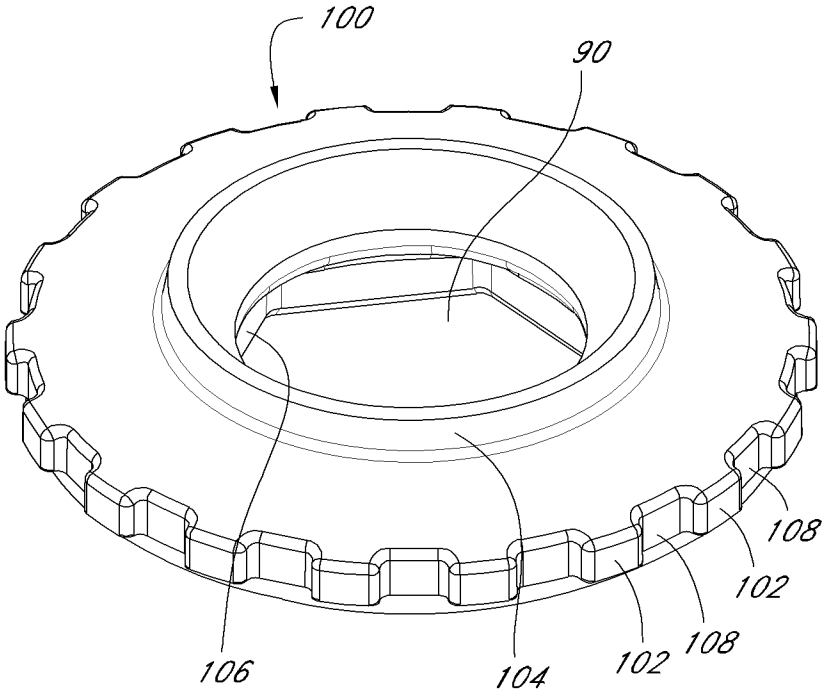
Figure 10A:
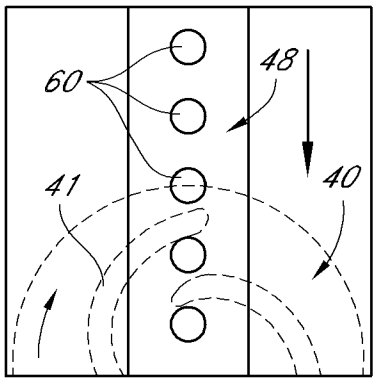
FIGS. 10A, 10B, 10C, 10D, 10E, and 10F illustrate a flowchart of the engagement of the strap pins of FIG. 4A with the cam spirals of FIG. 3C when the strap of FIG. 1 is being driven into the cam assembly of FIG. 1, in accordance with some embodiments of the inventions.
Figure 10B:
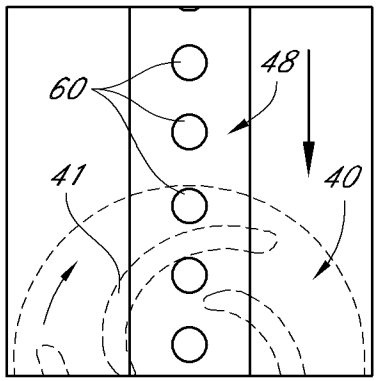
Figure 10C:
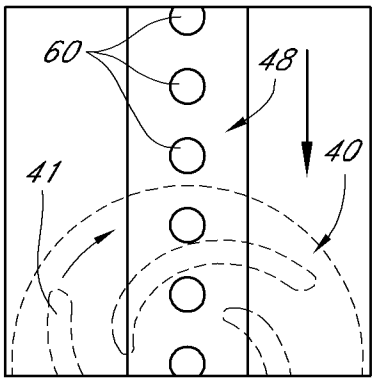
Figure 10D:
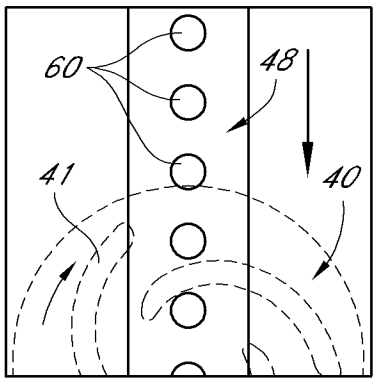
Figure 10E:
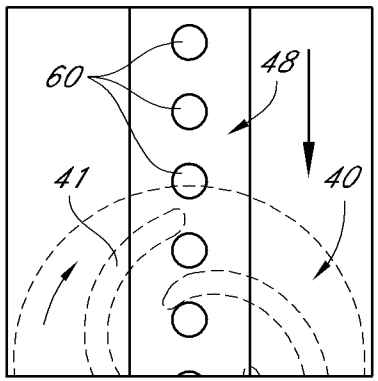
Figure 10F:
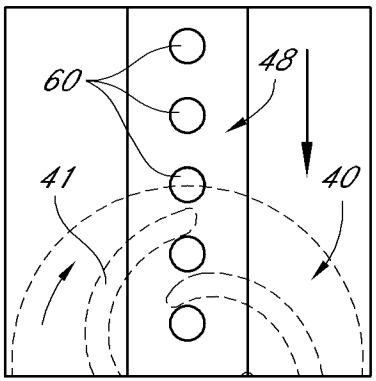
Figure 11A:
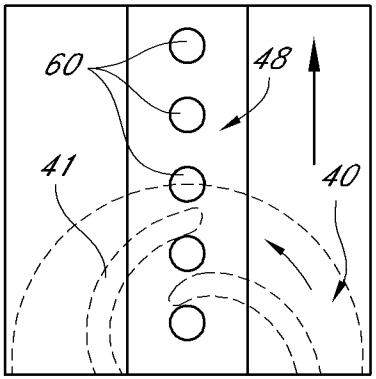
Figure 11B:
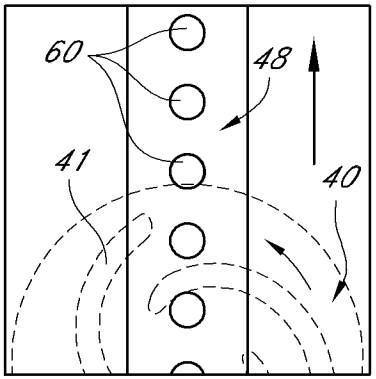
Figure 11C:
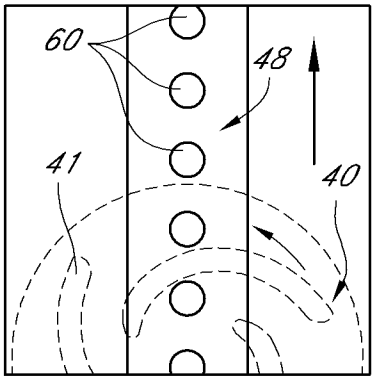
Figure 11D:
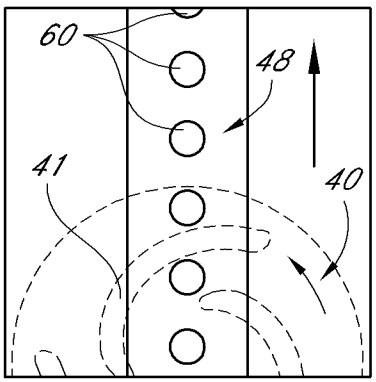
Figure 11E:
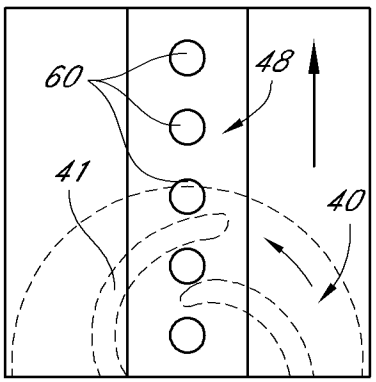
Figure 11F:
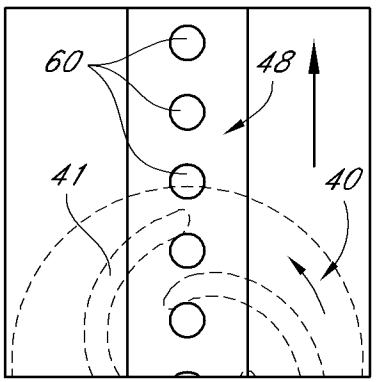

FIGS. 9A and 9B illustrate the undermold 100 of the knob 42 of FIG. 7 from a perspective and bottom view, in accordance with some embodiments of the inventions. In some embodiments, the undermold 100 has a cam opening 90, which allows the cam 40 to sit inside the knob 42. As previously mentioned the cam opening 90 may be in the form of any shape including a circle, square, oval, or triangle. In some embodiments, the undermold 100 also has one or more undermold teeth 102. In some embodiments, the undermold teeth 102 allow the undermold 100 and the overmold 92 to be snapped together and unitized when the overmold 92 has corresponding overmold teeth 94 that fit in the one or more undermold grooves or channels 108 of the undermold 100. As described above, in some embodiments the overmold 92 may be injection molded around a pre-made undermold 100. In some embodiments, the cam 40 and the knob 42 may be a single component; two components; three components, such as an overmold 92, an undermold 100, and a cam 40; or four or more components.

As further depicted in the bottom view of FIG. 9B, the undermold 100 of the knob 42 may have one or more cam channels or grooves 106. As previously discussed, in some embodiments, the cam channels 106 may be fitted to the shape of the crown 47 of the cam 40, and allow the cam 40 to attach to the knob 42. In some embodiments, once the cam 40 has been correctly positioned, and the knob 42 is positioned over the cam 40, the two may be snapped together using a locking mechanism or interference fit. In another embodiment, the crown may be placed on the knob 42 and channels matching the shape of the knob crown on the cam 40. Yet alternatively, the cam 40 and knob 42 may be adhered together, divided into three or more components, be a single component, or attached using other means. In some embodiments, the outer edge of some or all of the knob 42 may include friction enhancing features such as outward projections or inwards grooves to increase the traction a user's hand would have on the knob 42.

FIGS. 10A, 10B, 10C, 10D, 10E, and 10F illustrate a flowchart of the engagement of the strap pins 60 of FIG. 4A with the cam spirals 41 of FIG. 3C when the strap 48 of FIG. 1 is being driven into the cam assembly 30 of FIG. 1, in accordance with some embodiments of the inventions. Proceeding alphabetically, each figure represents the progression of the strap 48 into the cam assembly 30 over subsequent steps of time. The cam spirals 41 of the cam 40 may drive the strap 48 into the cam assembly 30, and may engage them at a constant angle. In some embodiments, a lower contact angle may be chosen to automatically lock the strap 48 into the cam assembly 30. Alternatively, higher contact angles may be chosen to increase the wind speed. If the cam assembly 30 is not self-locking, an external lock such as a button or lever may be incorporated to allow the user to lock the cam assembly 30 in a desired location. In some embodiments, where the cam assembly 30 is self-locking, a secondary locking mechanism is still provided to ensure the closure system remains in position when force is applied in the inwards and/or outward directions.

FIGS. 11A, 11B, 11C, 1D, 11E, and 11F illustrate a flowchart of the engagement of the strap pins 60 of FIG. 4A with the cam spirals 41 of FIG. 3C when the strap 48 of FIG. 1 is being driven out of the cam assembly 30 of FIG. 1, in accordance with some embodiments of the inventions. Proceeding alphabetically, each figure represents the progression of the strap 48 out of the cam assembly 30 over subsequent steps of time. The cam spirals 41 of the cam 40 drive the strap 48 out of the cam assembly 30, and may engage them at a constant angle. In some embodiments, a lower contact angle may be chosen to automatically lock the strap 48 into the cam assembly 30. Alternatively, higher contact angles may be chosen to increase the wind speed.

Figure 12:
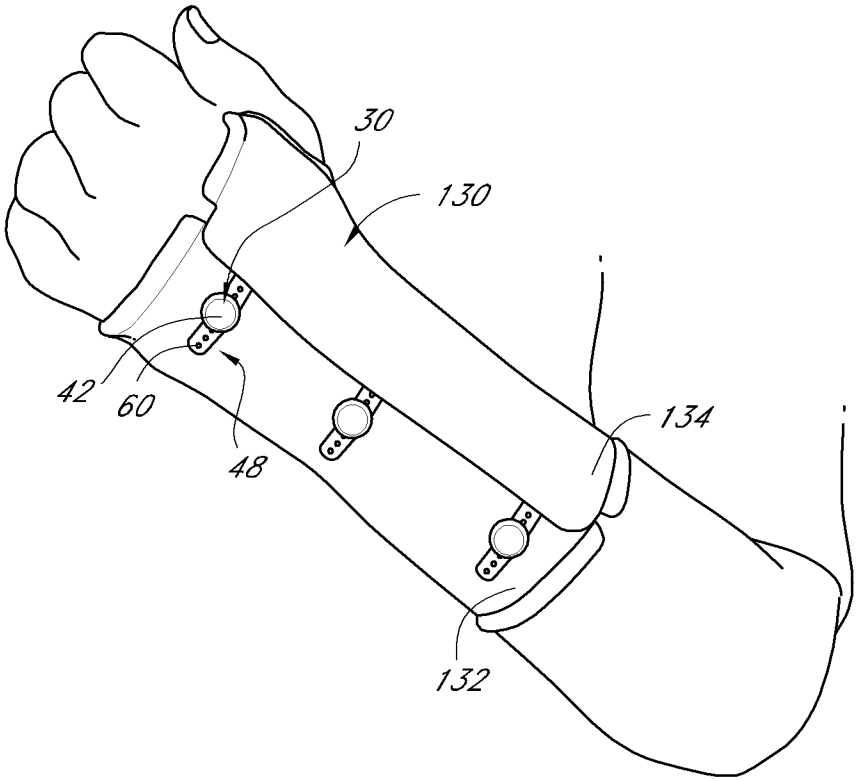
FIG. 12 illustrates use of the cam assembly and strap based closure system of FIG. 1 on a medical brace, in accordance with some embodiments of the inventions.

FIG. 12 illustrates use of the cam assembly 30 and strap 48 based closure system of FIG. 1 on a medical brace 130, in accordance with some embodiments of the inventions. In this embodiment, the cam assembly 30 is positioned on a first side 132 of the brace 130, and the strap 48 is positioned on a second side 134 of the brace 130. The cam assembly 30 and strap 48 may be positioned on their respective sides using adhesive, stitching, and/or various other fastening devices. In some embodiments, when the knob 42 is rotated, the strap 48 is driven into the cam assembly 30, and the first side 132 and second side 134 of the brace 130 are brought towards each other. When the knob 42 is rotated in an opposite direction the strap 48 is driven away from the cam assembly 30, and the first side 132 and second side 134 of the brace 130 are pulled away from each other.

Figure 19:
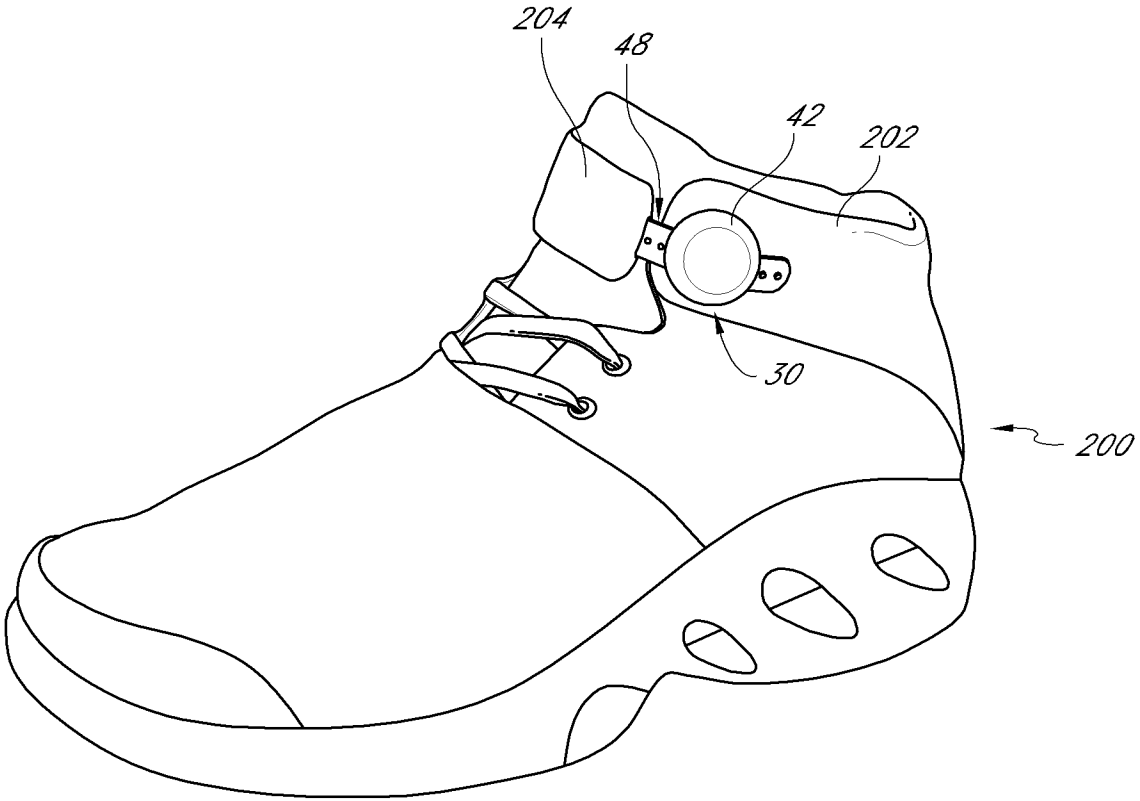
FIG. 19 illustrates use of the cam assembly and strap based closure system of FIG. 1 on a shoe as a powerstrap, in accordance with some embodiments of the inventions.

Multiple cam assembly 30 and strap 48 based closure systems may be provided to allow customized tension to be applied on the brace 130. As shown, three systems may be provided. In some embodiments, one, two, four or more assemblies may be provided. In addition, the cam assembly 30 and strap 48 systems disclosed herein may be used in conjunction with other known closure systems to provide the ultimate fit. For example, the article may be partially laced, velcroed, or buckled in place in addition to one or more cam assembly 30 and strap 48 based systems. Examples of such combination systems are shown in FIG. 19-FIG. 21.

Figure 13:
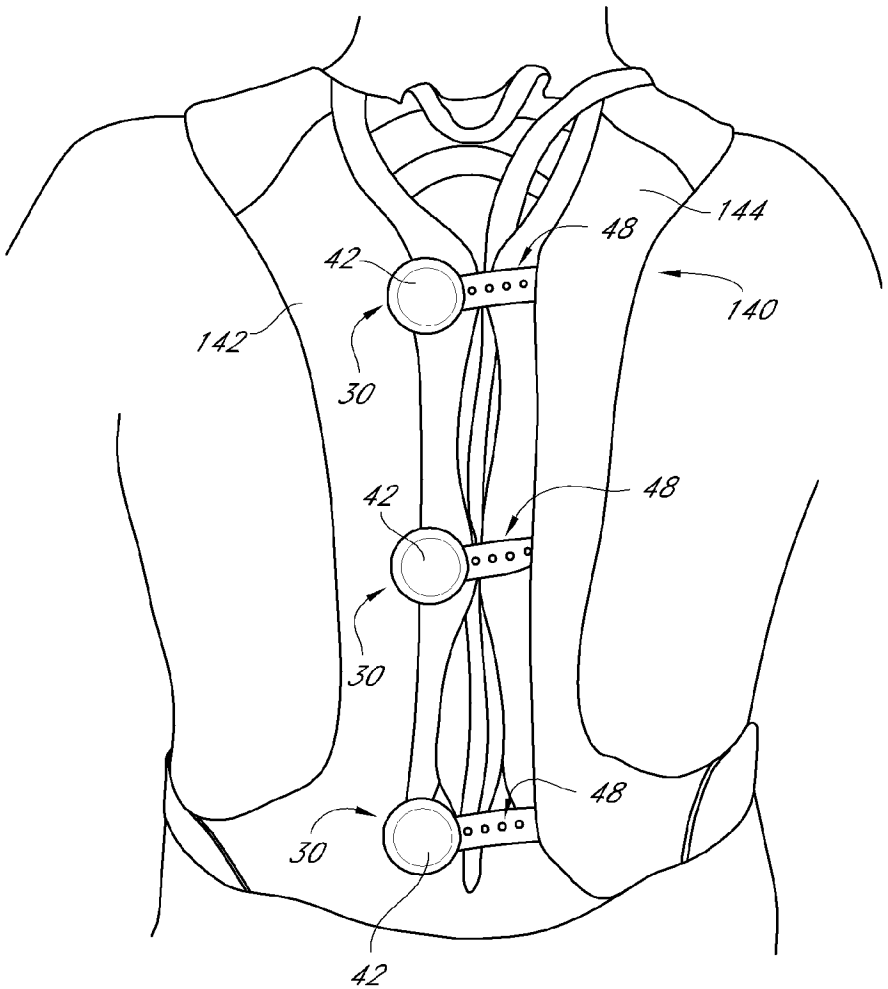
FIG. 13 illustrates use of the cam assembly and strap based closure system of FIG. 1 on a pack, in accordance with some embodiments of the inventions.

FIG. 13 illustrates use of the cam assembly 30 and strap 48 based closure system of FIG. 1 on a pack 140, in accordance with some embodiments of the inventions. In this embodiment, multiple cam assemblies 30 are positioned on a first side 142 of the pack 140, and multiple straps 48 are positioned on a second side 144 of the pack 140. The cam assemblies 30 and straps 48 may be positioned on their respective sides using adhesive, stitching, and/or various other fastening devices. In some embodiments, when the knob 42 is rotated the strap 48 is driven into the cam assembly 30, and the first side 142 and second side 144 of the pack 140 are brought towards each other. When the knob 42 is rotated in an opposite direction the strap 48 is driven away from the cam assembly 30, and the first side 142 and second side 144 of the pack 140 are pulled away from each other.

Figure 14:
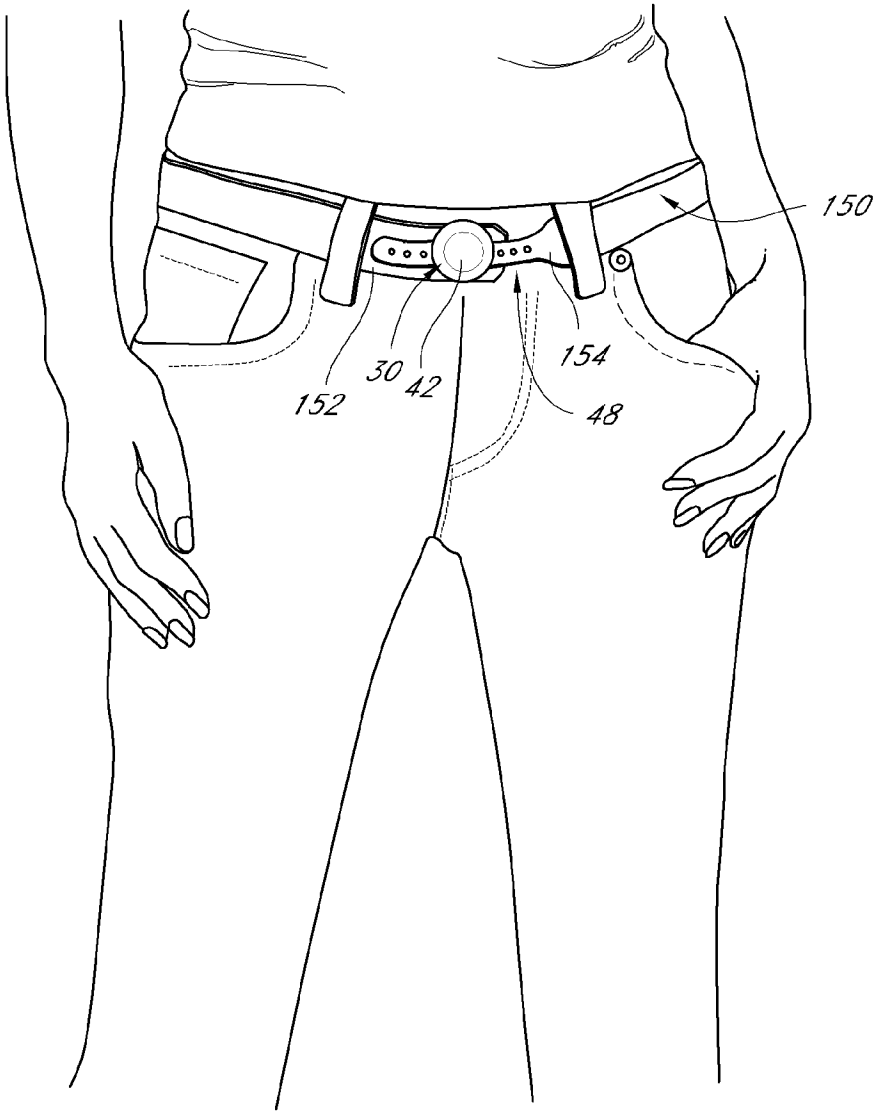
FIG. 14 illustrates use of the cam assembly and strap based closure system of FIG. 1 on a belt, in accordance with some embodiments of the inventions.

FIG. 14 illustrates use of the cam assembly 30 and strap 48 based closure system of FIG. 1 on a belt 150, in accordance with some embodiments of the inventions. In this embodiment, the cam assembly 30 is positioned on a first side 152 of the belt 150, and the strap 48 is positioned on a second side 154 of the belt 150. The cam assembly 30 and strap 48 may be positioned on their respective sides using adhesive, stitching, and/or various other fastening devices. In some embodiments, when the knob 42 is rotated the strap 48 is driven into the cam assembly 30, and the first side 152 and second side 154 of the belt 150 are brought towards each other. When the knob 42 is rotated in an opposite direction the strap 48 is driven away from the cam assembly 30, and the first side 142 and second side 144 of the belt 150 are pulled away from each other.

Figure 15:
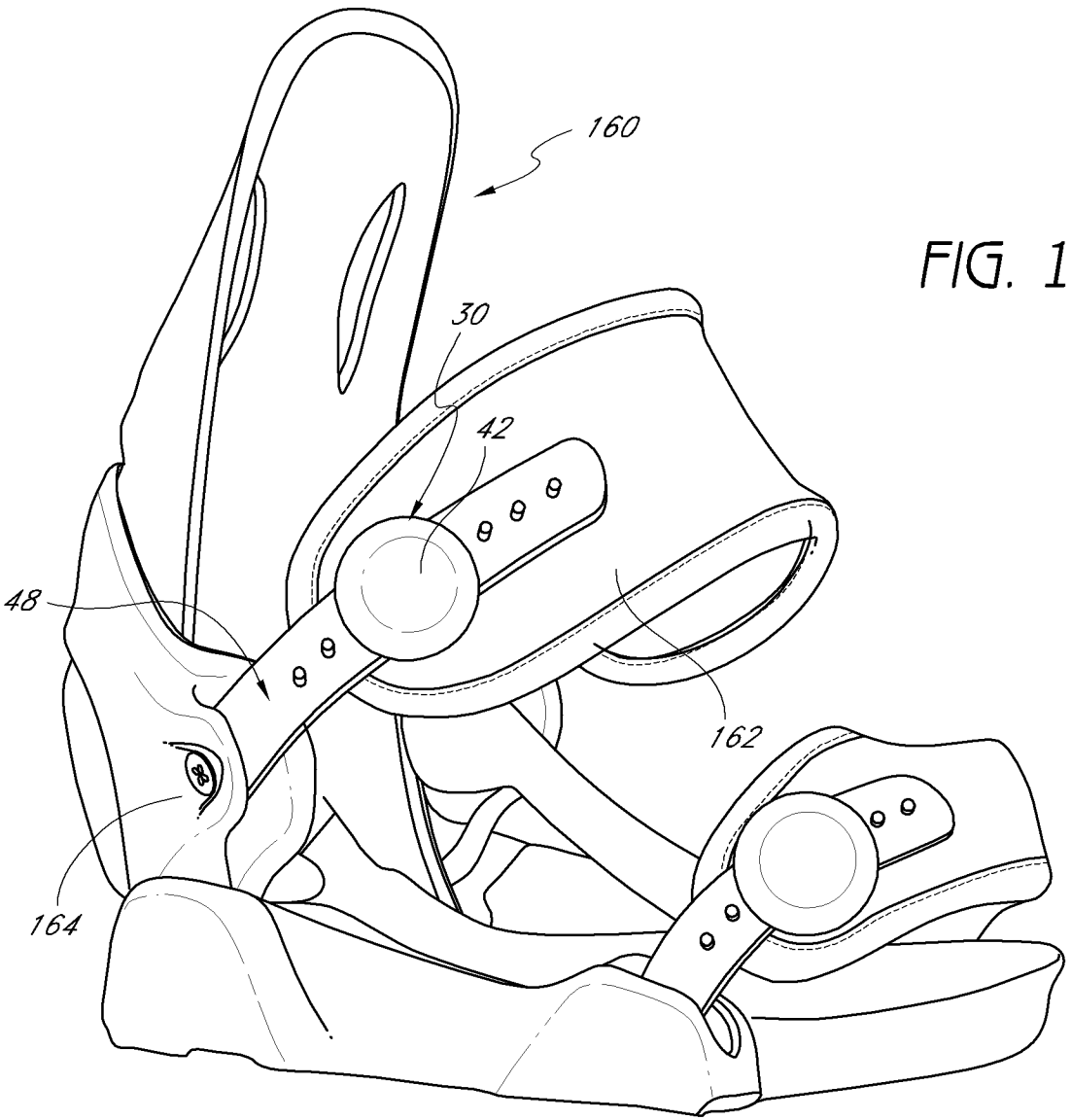
FIG. 15 illustrates use of the cam assembly and strap based closure system of FIG. 1 on a snowboard binding, in accordance with some embodiments of the inventions.

FIG. 15 illustrates use of the cam assembly and strap based closure system of FIG. 1 on a snowboard binding 160, in accordance with some embodiments of the inventions. In this embodiment, the cam assembly 30 is positioned on a first side 162 of the snowboard binding 160, and the strap 48 is positioned on a second side 164 of the snowboard binding 160. The cam assembly 30 and strap 48 may be positioned on their respective sides using adhesive, stitching, and/or various other fastening devices. In some embodiments, when the knob 42 is rotated the strap 48 is driven into the cam assembly 30, and the first side 162 and second side 164 of the snowboard binding 160 are brought towards each other. When the knob 42 is rotated in an opposite direction the strap 48 is driven away from the cam assembly 30, and the first side 162 and second side 164 of the snowboard binding 160 are pulled away from each other.

In an alternate embodiment the strap 48 and cam assembly 30 may be fastened to two or more objects to draw them towards and/or away from each other. In this embodiment, the cam assembly 30 is positioned on a first object and the strap 48 on a second object. The cam assembly 30 and strap 48 may be positioned on their respective sides using adhesive, stitching, and/or various other fastening devices. When the knob 42 is rotated the strap 48 is driven into the cam assembly 30, and the first object and second object are brought towards each other. When the knob 42 is rotated in an opposite direction the strap 48 is driven out of the cam assembly 30, and the first object and second object are pulled away from each other.

Figure 16:
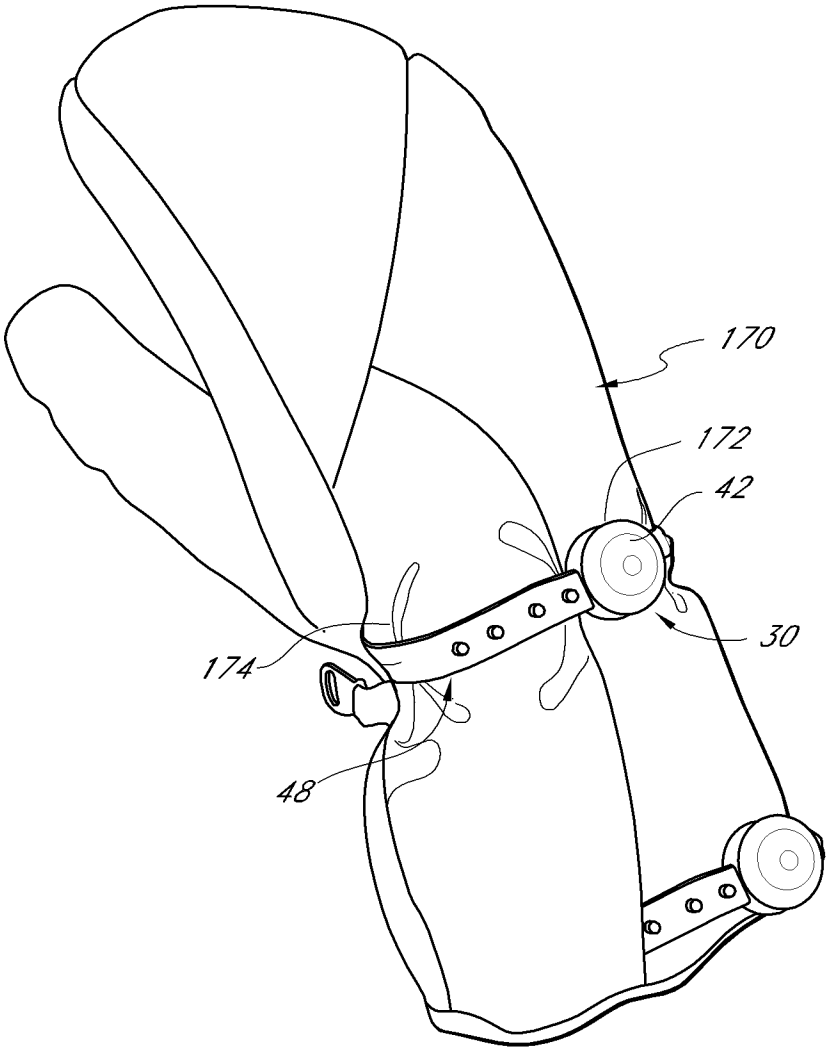
FIG. 16 illustrates use of the cam assembly and strap based closure system of FIG. 1 on a glove, in accordance with some embodiments of the inventions.

FIG. 16 illustrates use of the cam assembly 30 and strap 48 based closure system of FIG. 1 on a glove 170, in accordance with some embodiments of the inventions. In this embodiment, the cam assembly 30 is positioned on a first side 172 of the glove 170, and the strap 48 is positioned on a second side 174 of the glove 170. The cam assembly 30 and strap 48 may be positioned on their respective sides using adhesive, stitching, and/or various other fastening devices. In some embodiments, when the knob 42 is rotated the strap 48 is driven into the cam assembly 30, and the first side 172 and second side 174 of the glove 170 are brought towards each other. When the knob 42 is rotated in an opposite direction the strap 48 is driven away from the cam assembly 30, and the first side 172 and second side 174 of the glove 170 are pulled away from each other.

Figure 17:
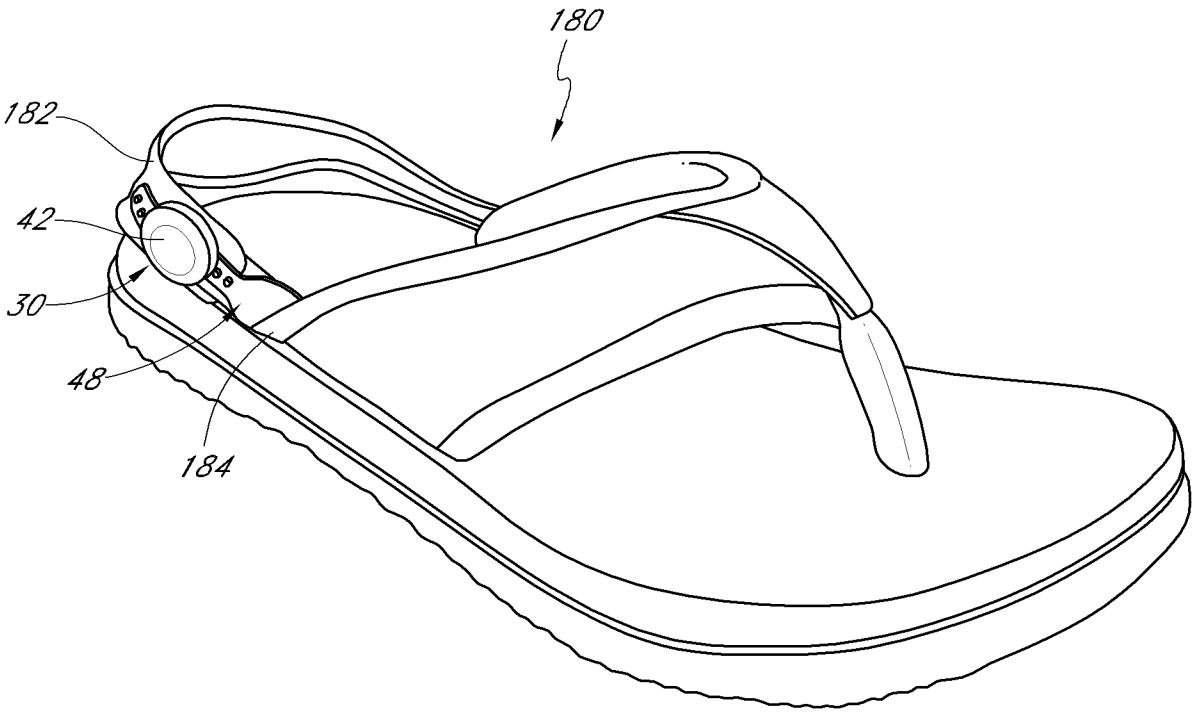
FIG. 17 illustrates use of the cam assembly and strap based closure system of FIG. 1 on a sandal, in accordance with some embodiments of the inventions.

FIG. 17 illustrates use of the cam assembly 30 and strap 48 based closure system of FIG. 1 on a sandal 180, in accordance with some embodiments of the inventions. In this embodiment, the cam assembly 30 is positioned on a first side 182 of the sandal 180, and the strap 48 is positioned on a second side 184 of the sandal 180. The cam assembly 30 and strap 48 may be positioned on their respective sides using adhesive, stitching, and/or various other fastening devices. In some embodiments, when the knob 42 is rotated the strap 48 is driven into the cam assembly 30, and the first side 182 and second side 184 of the sandal 180 are brought towards each other. When the knob 42 is rotated in an opposite direction the strap 48 is driven away from the cam assembly 30, and the first side 182 and second side 184 of the sandal 180 are pulled away from each other.

Figure 18:
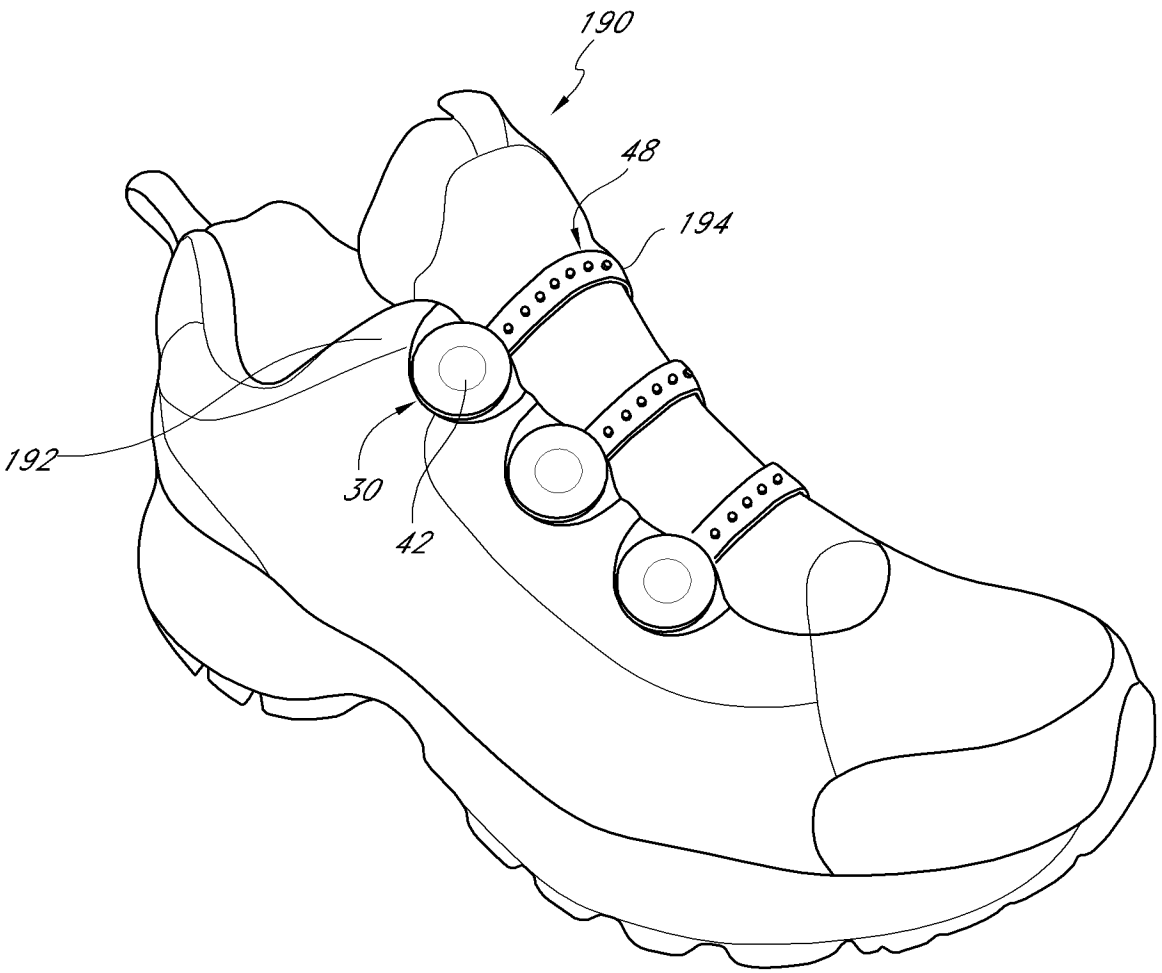
FIG. 18 illustrates use of the cam assembly and strap based closure system of FIG. 1 on a shoe as a zonal closure, in accordance with some embodiments of the inventions.

FIG. 18 illustrates use of the cam assembly 30 and strap 48 based closure system of FIG. 1 on a shoe 190 as a zonal closure, in accordance with some embodiments of the inventions. In this embodiment, multiple cam assemblies 30 are positioned on a first side 192 of the shoe 190, and multiple straps 48 are positioned on a second side 194 of the shoe 190. The cam assemblies 30 and straps 48 may be positioned on their respective sides using adhesive, stitching, and/or various other fastening devices. In some embodiments, when the knob 42 is rotated the strap 48 is driven into the cam assembly 30, and the first side 192 and second side 194 of the shoe 190 are brought towards each other. When the knob 42 is rotated in an opposite direction the strap 48 is driven away from the cam assembly 30, and the first side 192 and second side 194 of the shoe 190 are pulled away from each other.

FIG. 19 illustrates use of the cam assembly 30 and strap 48 based closure system of FIG. 1 on a shoe 200 as a powerstrap to apply additional closing force on or near the ankle of a wearer, in accordance with some embodiments of the inventions. In this embodiment, the cam assembly 30 is positioned on a first side 202 of the shoe 200, and the strap 48 is positioned on a second side 204 of the shoe 200. The cam assembly 30 and strap 48 may be positioned on their respective sides using adhesive, stitching, and/or various other fastening devices. In some embodiments, when the knob 42 is rotated the strap 48 is driven into the cam assembly 30, and the first side 202 and second side 204 of the shoe 200 are brought towards each other. When the knob 42 is rotated in an opposite direction the strap 48 is driven away from the cam assembly 30, and the first side 202 and second side 204 of the shoe 200 are pulled away from each other.

Figure 20B:
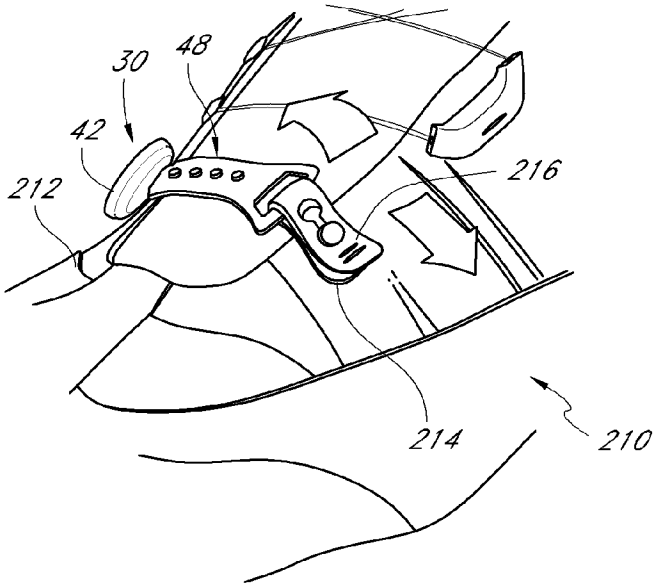
FIGS. 20A, 20B, and 20C illustrate the use of a detachable strap based adjustment memory with the cam assembly and strap based closure system of FIG. 1 on a shoe, in accordance with some embodiments of the inventions.
Figure 20C:
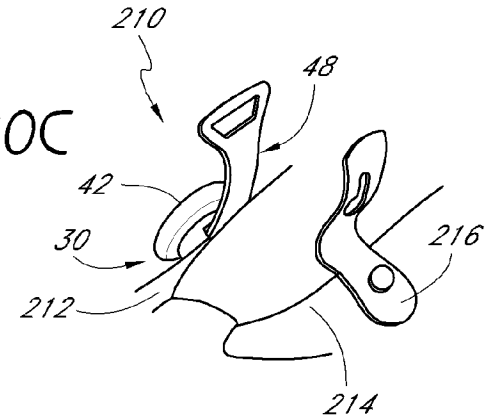
Figure 20A:
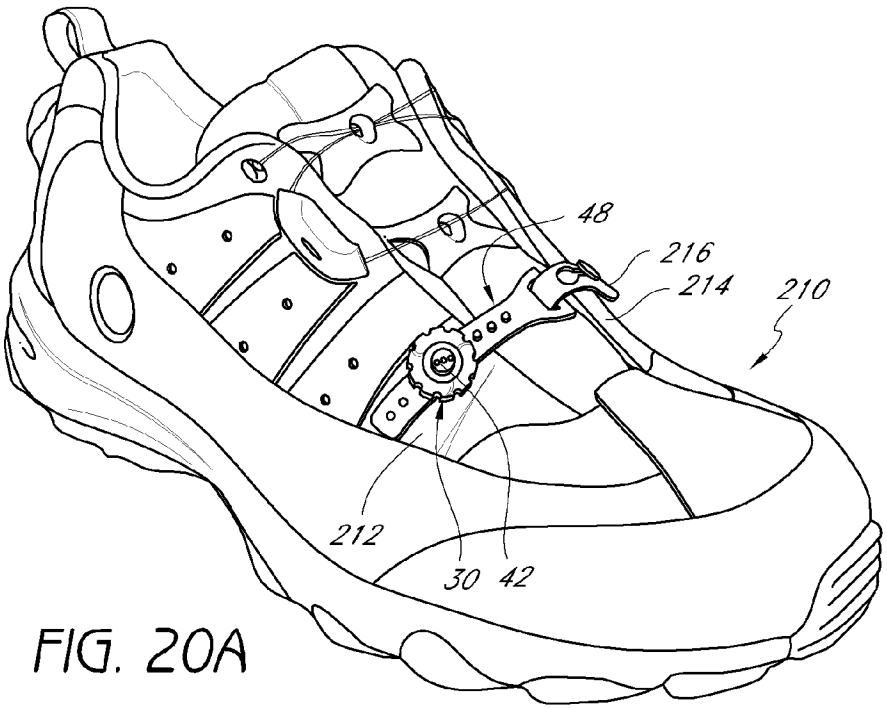

FIGS. 20A, 20B, and 20C illustrate the use of a detachable strap based adjustment memory with the cam assembly 30 and strap 48 based closure system of FIG. 1 on a shoe 210, in accordance with some embodiments of the inventions. In this embodiment, the knob 42 may be infinitely adjustable and can be left in a particular position for an ideal fit for a particular use. The cam assembly 30 may be positioned on a first side 212 of the shoe 210. The strap attachment 216 may be positioned on a second side 214 of the shoe 210, which may be the opposing end of the closure system. The strap attachment 216 may be a clasp, buckle, or hook that attaches to the strap 48, and may be capable of completely detaching from the strap 48. The cam assembly 30 and strap attachment 216 may be positioned on their respective sides using adhesive, stitching, and/or various other fastening devices. In some embodiments, when the knob 42 is rotated the strap 48 may be driven into the cam assembly 30, and the first side 212 and second side 214 of the shoe 210 are brought towards each other. When the knob 42 is rotated in an opposite direction the strap 48 may be driven away from the cam assembly 30, and the first side 212 and second side 214 of the shoe 210 are pulled away from each other.

In some embodiments, when the user releases the strap attachment 216 on the second side 214 of the shoe 210, the strap 48 may be released and detached from the strap attachment 216. The strap 48 may then be positioned in the cam 40, and thus the adjustment or position of the strap 48 within the cam 40 may be memorized or retained. This gross movement mechanism may allow some slack to be generated for release by the strap attachment 216, and the closure system to be a fine adjustment that can be retained for adjusting the strap 48. The gross movement mechanism may be particularly useful, in some embodiments, for rapid release and/or quick insertion.

Figure 21B:
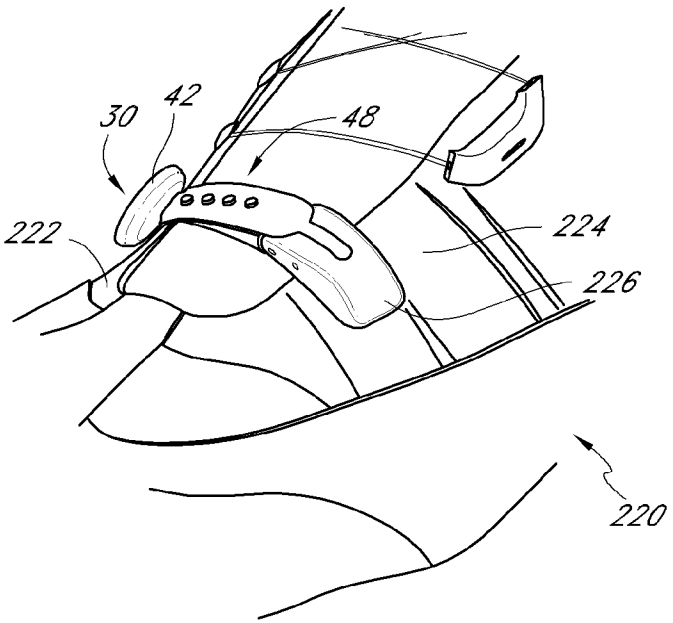
FIGS. 21A, 21B, and 21C illustrate the use of a latch based adjustment memory with the cam assembly and strap based closure system of FIG. 1 on a shoe, in accordance with some embodiments of the inventions.
Figure 21C:
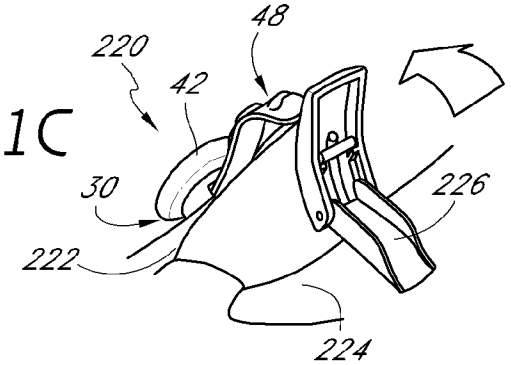
Figure 21A:
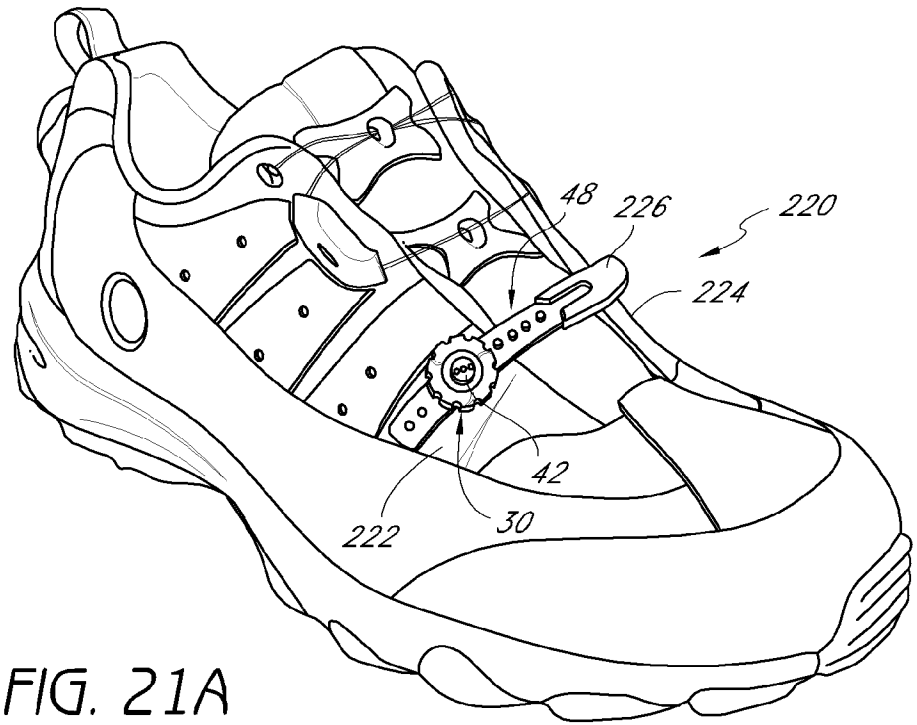

FIGS. 21A, 21B, and 21C illustrate the use of a latch based adjustment memory with the cam assembly 30 and strap 48 based closure system of FIG. 1 on a shoe 220, in accordance with some embodiments of the inventions. In this embodiment, the knob 42 is infinitely adjustable and can be left in a particular position for an ideal fit for a particular use. The cam assembly 30 may be positioned on a first side 222 of the shoe 220. The latch 226 may be positioned on a second side 224 of the shoe 220, which may be the opposing end of the closure system. The latch 226 may be attached to the strap 48, and is capable of release. The cam assembly 30 and latch 226 may be positioned on their respective sides using adhesive, stitching, and/or various other fastening devices. In some embodiments, when the knob 42 is rotated the strap 48 may be driven into the cam assembly 30, and the first side 222 and second side 224 of the shoe 220 may be brought towards each other. When the knob 42 is rotated in an opposite direction the strap 48 may be driven away from the cam assembly 30, and the first side 222 and second side 224 of the shoe 220 may be pushed away from each other.

In some embodiments, when the user releases the latch 226 on the second side 224 of the shoe 220, the strap 48 is loosened. The strap 48 may then be positioned in the cam 40, and thus the adjustment or position of the strap 48 within the cam 40 is memorized or retained. This gross movement mechanism may allow some slack to be generated for release by the latch 226, and the closure system to be a fine adjustment that can be retained for adjusting the strap 48. The gross movement mechanism may be particularly useful, in some embodiments, for rapid release and/or quick insertion.

Figure 22:
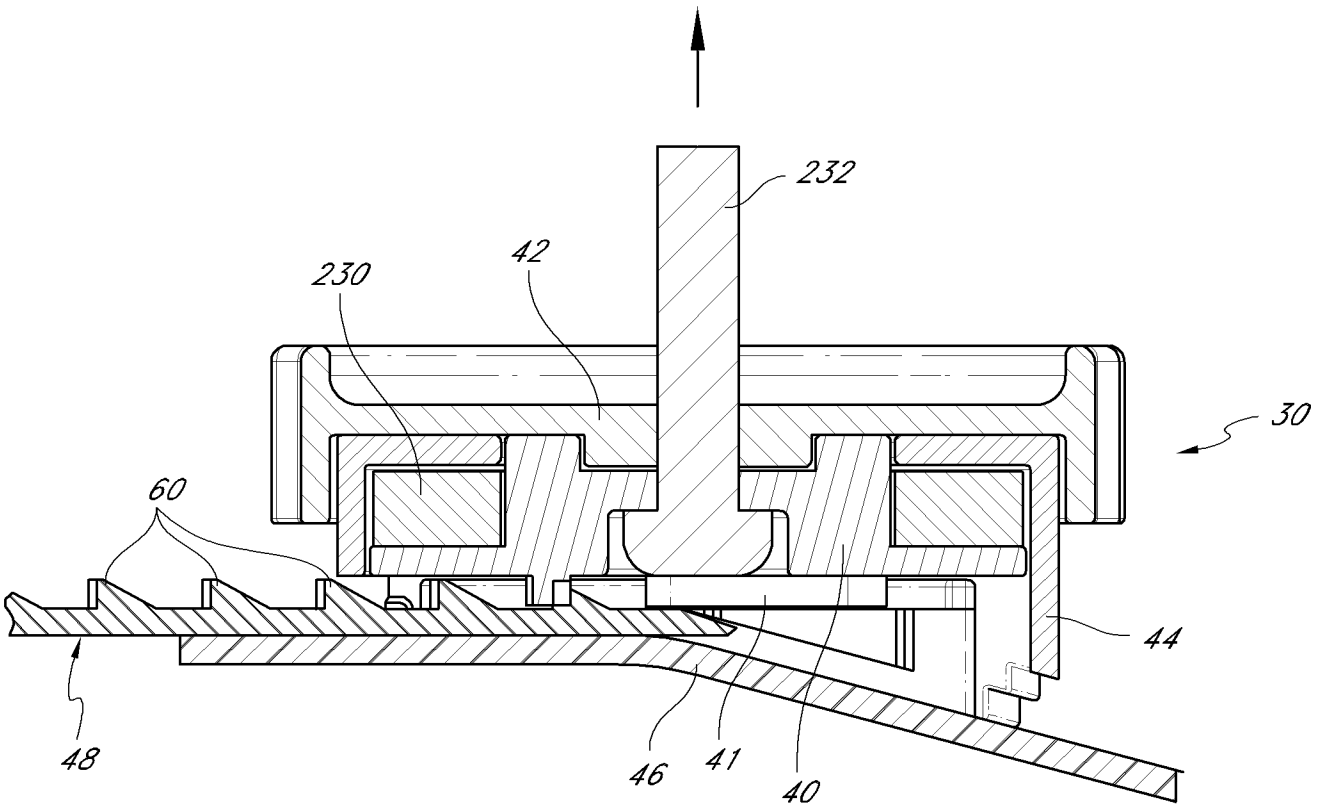
FIG. 22 illustrates a set of components for implementing a rapid release and/or quick insertion mechanism with the cam assembly and strap based closure system of FIG. 1 from a side view, in accordance with some embodiments of the inventions.

FIG. 22 illustrates a set of components for implementing a rapid release and/or quick insertion mechanism with the cam assembly 30 and strap 48 based closure system of FIG. 1 from a side view, in accordance with some embodiments of the inventions. As depicted in this drawing, a cam assembly 30 may comprise housing 44, a knob 42, a cam 40, and a track insert 46. The cam assembly 30 and housing 44 are adapted to receive a strap 48. In the illustrated embodiment, the housing 44 has a track insert 46 positioned inside the housing 44. The track insert 46 is adapted to allow a strap 48 to move in both in an inwards and outwards direction.

As further depicted in FIG. 22, the cam assembly 30 has a knob 42 and a cam 40. In some embodiments, once the cam 40 has been correctly positioned, and the knob 42 is positioned over the cam 40, the two may be snapped together using a locking mechanism. Alternatively, the cam 40 and knob 42 may be adhered together, divided into three or more components, or be a single component. The strap 48 may comprise one or more strap pins 60. In the illustrated embodiment the strap pins 60 are beveled. The wave washer 230 and the screw 232 allow the cam 40 and cam spirals 41 to be pulled in an upwards direction to disengage the strap 48 when the knob 42 is pulled upwards. The term "wave washer" is meant to define a broad term including, for example, springs, Belleville washers and cupped spring washers as well as its ordinary meaning. In an alternative embodiment, a spring may be used instead of a wave washer 230. When the knob is pushed downwards the cam 40 engages the strap 48 once again. In some embodiments, an elastomeric insert may be used instead to bias the cam 40 against the strap 48.

In some embodiments, the system may be configured to allow rapid release and/or quick insertion of the strap 48 for faster operation. If the cam 40 is not aligned with the strap pins 60, then once the knob 42 is turned the strap pins 60 are reengaged. This may be particularly useful to facilitate rapid release and/or quick insertion of the strap 48 for faster operation of the closure system. In addition, in some embodiments, the system may be detented so that the knob 42 and/or cam 40 can be snapped into a release position and then snapped directly downward into a position to drive the strap 48.

In the illustrated embodiment, quick insertion may be achieved by beveling the drive side of the strap pins 60, and using a wave washer 230 so that when the strap 48 is inserted the cam 40 can hop or pass over the beveled strap pins 60 when they are mated to a beveled cam spiral 41. This may be particularly useful for allowing the closure to open slowly, but also allowing rapid advancement or insertion of the strap 48. In some embodiments, the tension side of the strap pins 60 may be kept at approximately 90 degrees for maximum strength and retention.

In an alternate embodiment, the drive side of the strap pins 60 and cam spirals 41 may be beveled. This may be particularly useful for managing the forces applied to the system for strength and safety. For example, the knob 42 and cam 40 could pop upwards and release the strap 48 to prevent overloading of the system at a predetermined load. This is particularly useful in, for example, helmet or headwear applications.

Although these inventions have been described in terms of certain embodiments and applications, other embodiments and applications that are apparent to those of ordinary skill in the art, including embodiments which do not provide all of the features and advantages set forth herein, are also within the scope of these inventions.

What is claimed is:

1. A reel and strap based system for bringing two sides of an article together, the system comprising:

a housing adapted to receive a strap, the housing comprising a track insert provided in the housing, the track insert configured to receive the strap;

said strap adapted to feed into the housing and track insert, the strap comprising strap pins configured to engage in a cam;

said cam comprising at least one spiral, the cam configured to pull the strap pins, wherein the at least one spiral comprises a logarithmic spiral; and a knob configured to rotate said cam.

2. The system of claim 1, wherein the track insert is configured to pull the strap away from the cam to disengage the at least one spiral such that the at least one spiral is engaged in a reduced number of strap pins.

3. The system of claim 2, wherein the track insert further comprises a guide component.

4. The system of claim 3, wherein the guide component is a S-shape.

5. The system of claim 1, wherein the cam is configured to pull the strap pins at a linear velocity and constant contact angle.

6. The system of claim 5, wherein the constant contact angle is between approximately 0 degrees and approximately 20 degrees.

7. The system of claim 6, wherein the constant contact angle is between approximately 10 degrees and approximately 12 degrees.

8. The system of claim 1, wherein the cam is configured to pull the strap pins at a constant contact angle, said constant contact angle being self-locking wherein the self-locking prevents the strap from being pulled in an inwards direction from the housing when the knob is not rotating.

9. The system of claim 1, wherein the torque felt on the knob is constant.

10. The system of claim 1, wherein the knob is infinitely adjustable.

11. The system of claim 1, wherein the strap further comprises a chamfer.

12. The system of claim 1, further comprising a wave washer configured to pull the cam in an upwards direction to disengage the strap.

13. The system of claim 12, wherein the knob is configured to push the cam against the strap upon release.

14. The system of claim 12, further comprising at least one detent.

15. The system of claim 1, further comprising a spring configured to pull the cam in an upwards direction to disengage the strap.

16. The system of claim 1, further comprising a spring and wherein at least one of the strap pins is beveled.

17. The system of claim 16, wherein the cam is configured to hop over the beveled strap pin when the beveled strap pin is mated to the at least one spiral.

18. The system of claim 1, wherein the strap pins are 90 degrees relative to the strap.

19. The system of claim 1, wherein at least one of the strap pins is beveled on a drive side and the at least one spiral is beveled.

20. The system of claim 19, wherein the cam is configured to release the strap to prevent overloading at predetermined load.

21. The system of claim 1, wherein a free end of the strap is fixed to one side of the article and the housing is fixed to the other side of the article.

22. A shoe that includes the system of claim 1.

23. A sandal that includes the system of claim 1.

24. A helmet that includes the system of claim 1.

25. A medical brace that includes the system of claim 1.

26. A pack that includes the system of claim 1.

27. A football pad that includes the system of claim 1.

28. A snowboard binding that includes the system of claim 1.

29. A glove that includes the system of claim 1.

30. A belt that includes the system of claim 1.

31. A method for drawing two objects towards each other, the method comprising:

providing a housing adapted to receive a strap, the housing comprising a track insert provided in the housing, the track insert configured to receive the strap;

adapting said strap to feed into the housing and track insert, the strap comprising strap pins configured to engage in a cam;

configuring said cam to pull the strap pins, the cam comprising at least one spiral, wherein the at least one spiral comprises a logarithmic spiral;

providing a knob configured to rotate the cam;

positioning the housing, the cam, and the knob on a first object;

positioning the strap on a second object; and rotating the knob to drive the strap into the housing to pull the first object and second object towards each other.

32. The method of claim 25, further comprising configuring the cam to pull the strap pins at a linear velocity and constant contact angle.

33. The method of claim 25, further comprising configuring the track insert to pull the strap away from the cam to disengage the at least one spiral such that the at least one spiral is engaged in a reduced number of strap pins.

34. The method of claim 25, wherein the track insert further comprises a guide component.

35. The method of claim 28, wherein the guide component is a S-shape.

36. A method for drawing two objects away from each other, the method comprising:

providing a housing adapted to receive a strap, the housing comprising a track insert provided in the housing, the track insert configured to receive the strap;

adapting said strap to feed into the housing and track insert, the strap comprising strap pins configured to engage in a cam;

configuring said cam to pull the strap pins, the cam comprising at least one spiral, wherein the at least one spiral comprises a logarithmic spiral;

providing a knob configured to rotate the cam;

positioning the housing, the cam, and the knob on a first object;

positioning the strap on a second object; and rotating the knob to drive the strap away from the housing to push the first object and second object away from each other.

37. The method of claim 36, further comprising configuring the cam to pull the strap pins at a linear velocity and constant contact angle.

38. The method of claim 36, further comprising configuring the track insert to pull the strap away from the cam to disengage the at least one spiral such that the at least one spiral is engaged in a reduced number of strap pins.

39. The method of claim 36, wherein the track insert further comprises a guide component.

40. The method of claim 39, wherein the guide component is a S-shape.

* * * * *